US012575632B2

(12) United States Patent
Yoon et al.

(10) Patent No.: US 12,575,632 B2
(45) Date of Patent: Mar. 17, 2026

(54) HEAD PROTECTION GEAR

(71) Applicant: HJC corp., Yongin-si (KR)

(72) Inventors: Man Geun Yoon, Seoul (KR); Chang Seob Lee, Yongin-si (KR)

(73) Assignee: HJC corp., Yongin-si (KR)

( * ) Notice: Subject to any disclaimer, the term of this patent is extended or adjusted under 35 U.S.C. 154(b) by 0 days.

(21) Appl. No.: 18/854,958

(22) PCT Filed: Mar. 30, 2023

(86) PCT No.: PCT/KR2023/004283
§ 371 (c)(1),
(2) Date: Oct. 7, 2024

(87) PCT Pub. No.: WO2023/214690
PCT Pub. Date: Nov. 9, 2023

(65) Prior Publication Data

US 2025/0295195 A1 Sep. 25, 2025

(30) Foreign Application Priority Data

May 3, 2022 (KR) ..... 10-2022-0054711

(51) Int. Cl.
*A42B 3/22* (2006.01)
*A42B 3/06* (2006.01)

(52) U.S. Cl.
CPC ..... *A42B 3/222* (2013.01); *A42B 3/225* (2013.01); *A42B 3/227* (2013.01); *A42B 3/06* (2013.01)

(58) Field of Classification Search
CPC ..... A42B 3/222; A42B 3/225; A42B 3/227; A42B 3/06
See application file for complete search history.

(56) References Cited

U.S. PATENT DOCUMENTS 3,593,338 A * 7/1971 Penny ..... A42B 3/225 2/427
4,432,100 A * 2/1984 Bates ..... A42B 3/225 2/424

(Continued)

FOREIGN PATENT DOCUMENTS

JP 2009074230 A 4/2009
JP 2018523020 A 8/2018

(Continued)

OTHER PUBLICATIONS

International Search Report mailed Jul. 3, 2023, for International Application No. PCT/KR2023/004283.

*Primary Examiner* — Gloria M Hale
(74) *Attorney, Agent, or Firm* — Renner, Otto, Boisselle & Sklar, LLP

(57) ABSTRACT

Head protection gear is disclosed. The head protection gear according to one aspect of the present invention comprises: an outer frame having a frame opening that is open at the front side thereof; a sub-visor which partially covers the front side of the outer frame and which is movably coupled to the outer frame; support members, each being coupled to the outer frame and the sub-visor so as to movably support the sub-visor; and a movable member which is movably coupled to the support member, and which is coupled to the sub-visor so as to be movable together with the sub-visor, wherein the movable member can move between a first position at which the sub-visor opens the frame opening, and a second position at which the sub-visor at least partially covers the frame opening.

16 Claims, 13 Drawing Sheets

(56) References Cited

U.S. PATENT DOCUMENTS

| | | | | |
|---|---|---|---|---|
| 5,177,816 | A | 1/1993 | Schmidt et al. | |
| 9,032,548 | B2 | 5/2015 | Isobe | |
| 2006/0000011 | A1* | 1/2006 | Reichow | A42B 3/225 2/427 |
| 2013/0025015 | A1* | 1/2013 | Isobe | A42B 3/222 2/10 |
| 2015/0082520 | A1* | 3/2015 | Cheng | A42B 3/226 2/411 |
| 2016/0015114 | A1* | 1/2016 | Berthier | A42B 3/222 2/424 |
| 2016/0029734 | A1* | 2/2016 | Kurpjuweit | A42B 3/205 2/427 |

FOREIGN PATENT DOCUMENTS

| | | | |
|---|---|---|---|
| JP | 6789266 | B2 | 11/2020 |
| KR | 200439851 | Y1 | 5/2008 |
| KR | 101878275 | B1 | 7/2018 |
| KR | 102040534 | B1 | 11/2019 |

* cited by examiner

HEAD PROTECTION GEAR

This application is a national phase of International Application No. PCT/KR2023/004283 filed Mar. 30, 2023, which claims priority to South Korean Application No. 10-2022-0054711 filed May 3, 2022, each of which is hereby incorporated herein by reference in its entirety.

TECHNICAL FIELD

The present invention relates to a head protection gear, and more particularly, to a head protection gear having a structure in which a member for blocking or reducing external light is easily manipulated.

BACKGROUND ART

Head protection gear is a commonly referred to as a helmet, and is used to protect a wearer's head.

The head protection gear has a space formed therein to accommodate the wearer's head. In order to safely protect the accommodated head, the head protection gear is generally configured to wrap the head from the outside. Accordingly, the space of the head protection gear and the accommodated head of the wearer are blocked from communicating with the outside.

The head protection gear is equipped with a member referred to as a visor. Usually, the visor is formed of a transparent material, so that the wearer wearing the head protection gear may visually identify the front side. At the same time, the visor prevents an inflow of external air into the interior of the head protection gear during driving, thereby protecting the wearer's eyes.

Recently, there has been an increase in the number of cases in which an additional visor for blocking light such as sunlight as well as blocking the inflow of external air is provided on the head protection gear. At this time, the visor already provided, that is, the visor provided to block the inflow of external air, and the additional visor may be rotated independently of each other.

However, the additional visor is generally located inside the visor for blocking the inflow of external air. Therefore, in order for the wearer to manipulate the position of the additional visor, there is inconvenience to pre-manipulate the visor for blocking the inflow of external air.

Korean Utility Model Document No. 20-0439851 discloses a sun visor for a motorcycle helmet. Specifically, disclosed is a sun visor rotatably provided on front of the safety glasses already provided in the helmet.

However, the sun visor for a motorcycle helmet disclosed in the above-mentioned related art document is disposed in front of a pre-equipped safety glasses. Therefore, there is a concern that the sun visor may be easily damaged by external foreign substances or the like while driving.

Moreover, the sun visor disclosed by the above-mentioned related art document is coupled to the helmet by magnetic force. Therefore, there is a fear that the stability of the coupling between the sun visor and the helmet may be reduced compared to the case of mechanical coupling.

Korean Patent Registration Document No. 10-2040534 discloses a shield for a helmet. More specifically, disclosed is a shield for a helmet including a sun visor that is provided on a shield and is rotatable based on a different rotation center from the shield.

However, in the helmet shield disclosed in the above-mentioned related art document, the sun visor is also disposed on the outside of the shield. Therefore, there is a concern that the sun visor may be easily damaged by external foreign substances or the like during driving.

In addition, according to the helmet shield disclosed in the above-mentioned related art document, the shield and the sun visor are coupled to the same member. Therefore, as the rotation of the shield and sun visor is repeated, there is a fear that the member supporting the rotation of the shield and sun visor may be easily damaged.

Furthermore, the sun visor disclosed by the above-mentioned related art documents is moved by the wearer directly grasping and pressing or pulling. Therefore, it is difficult to exclude the possibility that not only the sun visor but also the shield located inside the sun visor may move together against the intention of the wearer.

Korean Utility Model No. 20-0439851 (2008 May 8)
Korean Patent No. 10-2040534 (2019 Nov. 6)

DISCLOSURE

Technical Problem

The purpose of the present invention is to provide a head protection gear having a structure in which a position of a member for blocking or reducing external light may be easily manipulated.

Another purpose of the present invention is to provide a head protection gear having a structure in which the member may be easily moved to a predetermined position.

Another purpose of the present invention is to provide a head protection gear having a structure in which the predetermined position may be easily adjusted.

Another purpose of the present invention is to provide a head protection gear having a structure in which the member may be stably and reliably moved.

The technical problems of the present invention are not limited to the above-mentioned problems, and other technical problems not mentioned may be clearly understood by those skilled in the art to which the present invention pertains from the following description.

Technical Solution

According to an aspect of the present invention, there is provided a head protection gear including: an outer frame configured to open at a front side thereof via a frame opening; a sub-visor configured to partially cover the front side of the outer frame and be movably coupled to the outer frame; a supporter configured to be coupled to the outer frame and the sub-visor, respectively, and movably support the sub-visor; and a mover configured to be movably coupled to the supporter, and be movably together with the sub-visor while being connected to the sub-visor; wherein the mover is configured to be movably between a first position at which the sub-visor opens the frame opening; and a second position at which the sub-visor at least partially covers the frame opening.

In this case, the head protection gear may be provided in which the supporter includes: a supporting body configured to extend in one direction; and a moving groove configured to penetrate the supporting body and extend between each end of the supporting body in the extension direction, wherein the mover is movably coupled to the moving groove.

In addition, the head protection gear may be provided in which the moving groove includes: a first extension configured to have a center on one of a front side and a rear side, and extend with a predetermined first curvature; and a second extension configured to be continuous with the first extension, and have a center on the other of the front side and the rear side, and extend with a predetermined second curvature.

In this case, the head protection gear may be provided in which the first curvature of the first extension and the second curvature of the second extension are different from each other.

In addition, the head protection gear may be provided in which the first curvature of the first extension is configured to be greater than or equal to the second curvature of the second extension.

In this case, the head protection gear may be provided in which one of the first curvature of the first extension and the second curvature of the second extension is zero.

In addition, the head protection gear may be provided in which the moving groove includes: a plurality of extension, each of which forms a part thereof and is continuous with each other, wherein a pair of the extensions formed adjacent to each other among the plurality of extensions have centers on different sides of the front side and the rear side, respectively, and extend with different curvatures.

In this case, the head protection gear may be provided in which the supporter includes: a guider disposed to be spaced apart from the moving groove, and configured to extend between each end of the supporting body in the extension direction of the supporting body to guide the movement of the mover coupled to the supporter.

In addition, the head protection gear may be provided in which the guider includes: a guide groove configured to penetrate the supporting body; and a guide edge configured to cover the guide groove from the outside, and extend along the guide groove to support the mover coupled to the supporter.

In this case, the head protection gear may be provided in which the mover includes: a visor coupler to which the sub-visor is coupled; and a guide protrusion configured to protrude toward the supporter and movably coupled to a guide groove of the supporter.

In addition, the head protection gear may be provided in which the mover includes: a moving protrusion disposed to be spaced apart from the guide protrusion, and configured to protrude toward the supporter to be movably coupled to a moving groove penetrating the supporter.

In this case, the head protection gear may be provided in which the head protection gear includes: an adjuster configured to be movably provided on the outer frame, and disposed to be spaced apart from the supporter and the mover; and a wire configured to be respectively coupled to the adjuster and the mover, and moved together with them.

In addition, the head protection gear may be provided in which the adjuster includes: a multi-stage adjuster configured to be movably coupled to the outer frame along a predetermined path in one direction; and a moving adjuster configured to be movably coupled to the outer frame and the wire in a direction toward the multi-stage adjuster and in a direction opposite thereto along the other direction.

In this case, the head protection gear may be provided in which the multi-stage adjuster is maintained in one of: a first state located adjacent to one end of the predetermined path and spaced apart from the moving adjuster; a second state located between one end and the other end of the predetermined path and in contact with the moving adjuster; and a third state located adjacent to the other end of the predetermined path and in contact with the moving adjuster.

In addition, the head protection gear may be provided in which the multi-stage adjuster includes: a first adjusting end configured to protrude toward the one direction and be in contact with the moving adjuster in the second state; and a second adjusting end configured to be continuous with the first adjusting end and be in contact with the moving adjuster in the third state.

In this case, the head protection gear may be provided in which when the moving adjuster is maximally moved in a direction opposite to the multi-stage adjuster, the mover is moved to the first position.

Advantageous Effects

According to the above configuration, the position of the member for blocking or reducing external light can be easily manipulated in the head protection gear according to the embodiment of the present invention.

Further, according to the above configuration, the member may be easily moved to a predetermined position in the head protection gear according to the embodiment of the present invention.

Further, according to the above configuration, the predetermined position can be easily adjusted in the head protection gear according to the embodiment of the present invention.

Further, according to the above configuration, the member can be stably and reliably moved in the head protection gear according to the embodiment of the present invention.

It should be understood that the effects of the present invention are not limited to the above effects, and include all effects derivable from the configuration of the invention described in the detailed description or claims.

MODES OF THE INVENTION

Figure 1:
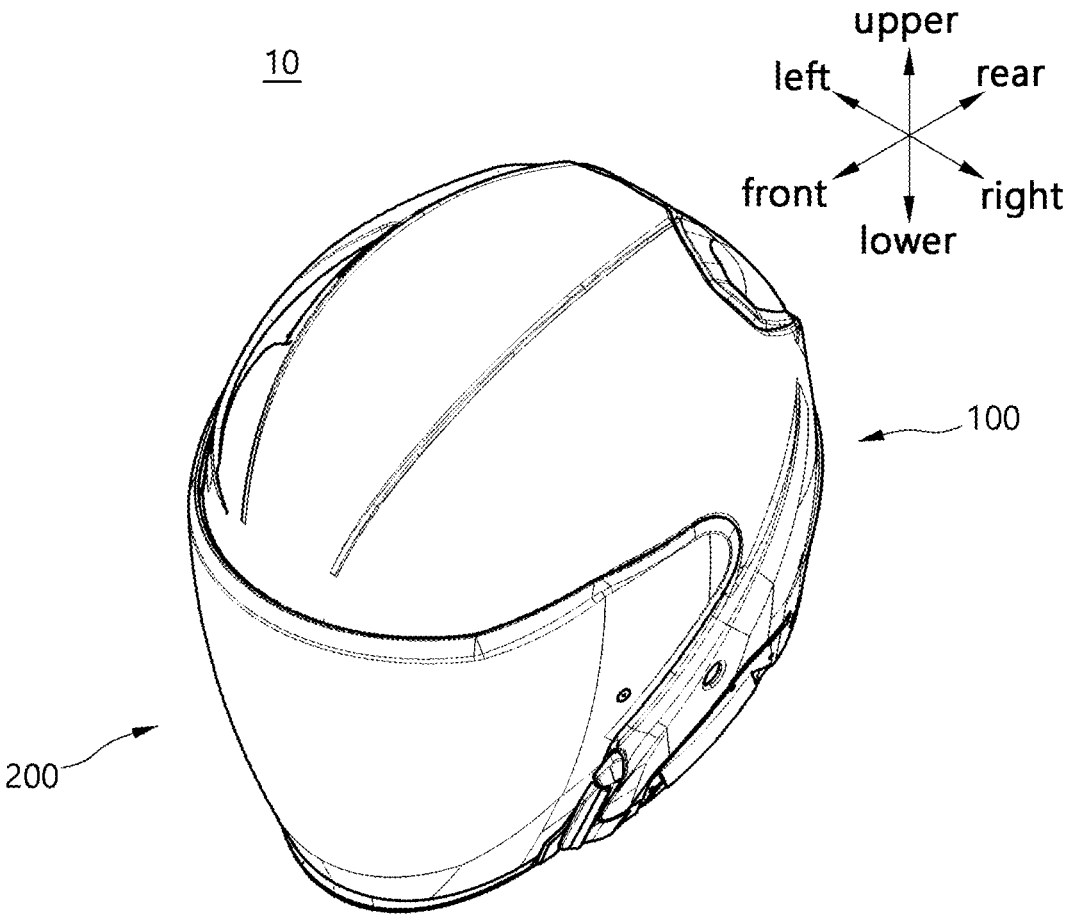
FIG. 1 is a perspective view showing a head protection gear according to an embodiment of the present invention.

Hereinafter, exemplary embodiments of the present disclosure will be described in detail so that those of ordinary skill in the art can readily implement the present disclosure with reference to the accompanying drawings. The present disclosure may be embodied in many different forms and is not limited to the embodiments set forth herein. In the drawings, parts unrelated to the description are omitted for clarity of description of the present invention, and throughout the specification, same or similar reference numerals denote same elements.

The words and terms used in this specification and the claims are not interpreted as limited to conventional or dictionary meanings, but should be interpreted as meanings and concepts consistent with the technical idea of the present invention according to the principle in which the inventor can define the terms and concepts in order to best explain their invention.

Therefore, the embodiments described in this specification and the configurations illustrated in the drawings correspond to a preferred embodiment of the present invention and do not all represent the technical idea of the present invention, so the corresponding configurations may be various equivalents and modifications to replace them at the time of filing the present invention.

In the following description, in order to clarify the features of the present invention, descriptions of some components may be omitted.

The term "curvature" described below refers to the degree to which a line or surface is curved. In an embodiment, the curvature may be defined as a reciprocal of a radius of curvature. In the above embodiment, it will be understood that the larger the curvature, the more the line or plane bends, and the smaller the curvature, the more the line or surface closer to a straight line or plane.

Therefore, in the following description, the expression "high curvature" may be used to indicate a relatively more curved state, and the expression "low curvature" may be used to indicate a relatively flat state.

The term "wire W" used in the following description means any member that can connect different members and transfer movement of one member to another member. In an embodiment, the wire W may be formed of a metal material and may be provided in the form of a string having a small elastic modulus. The wire W may be provided as a component of a head protection gear 10.

The terms "upper side", "lower side", "left side", "right side", "front side", and "rear side" used in the following description will be understood with reference to the coordinate system shown in FIG. 1.

Figure 2:
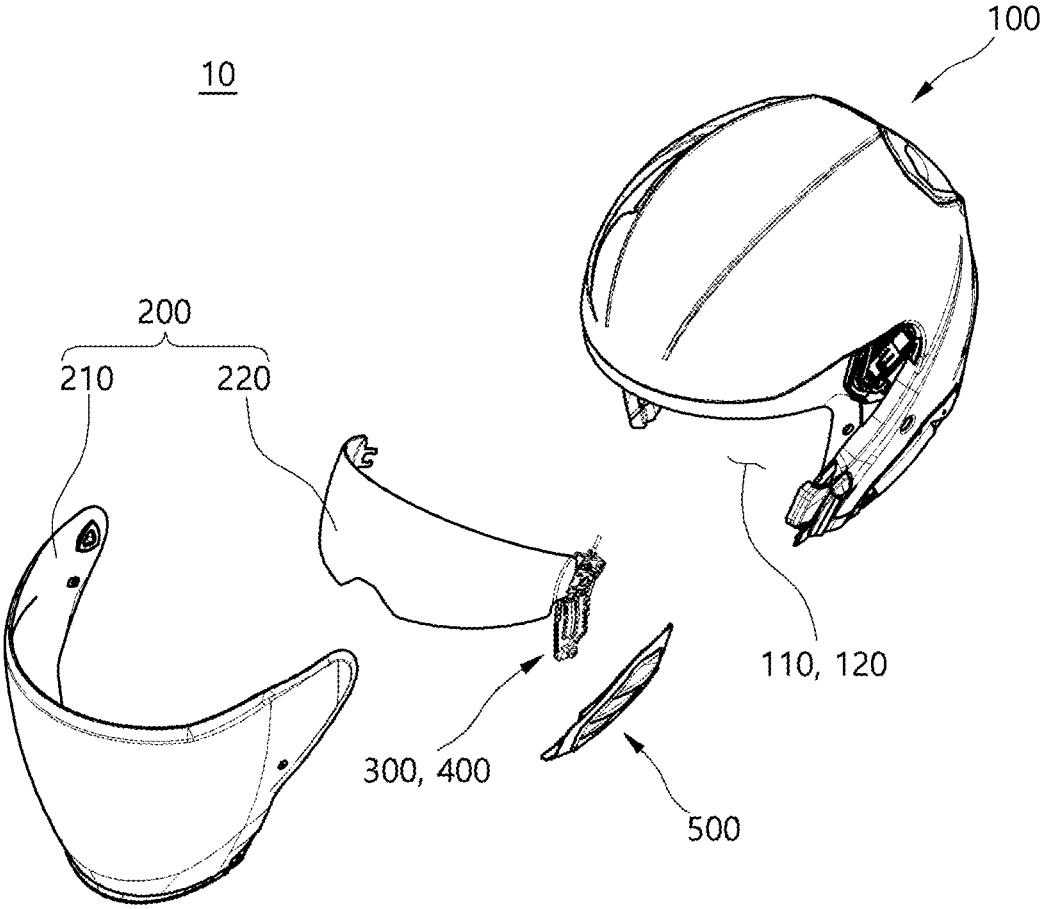
FIG. 2 is an exploded perspective view showing the configuration of the head protection gear of FIG. 1.

Referring to FIGS. 1 to 2, a head protection gear 10 according to an embodiment of the present invention is shown.

The head protection gear 10 according to an embodiment of the present invention is equipped with an additional member (i.e., the sub-visor 220) to block light or the like. The sub-visor 220 may be moved to one side or the other side by simple manipulation, and may be aligned with the gaze of the wearer.

In addition, the head protection gear 10 according to the embodiment of the present invention includes a mover 400 and an adjuster 500 coupled to the sub-visor 220. The wearer may adjust the position of the sub-visor 220 by manipulating the adjuster 500 without directly gripping the sub-visor 220.

Furthermore, the adjuster 500 provided in the head protection gear 10 according to an embodiment of the present invention may be adjusted in multiple stages. In other words, the distance at which the sub-visor 220 may be moved by the adjuster 500 may be adjusted in multiple stages. Therefore, the wearer may easily adjust the position of the sub-visor 220 without delicately adjusting the adjuster 500.

Referring to FIGS. 1 and 2, the head protection gear 10 according to an exemplary embodiment includes an outer frame 100, a visor 200, a supporter 300, a mover 400, and an adjuster 500.

The outer frame 100 forms the outer shape of the head protection gear 10. A space (accommodation space 110 to be described later) may be formed inside the outer frame 100 to accommodate the wearer' head. The outer frame 100 may protect the wearer' head from an external impact or the like.

The outer frame 100 may be formed of a lightweight and highly rigid material. This is to effectively protect the wearer's head while minimizing the foreign body sensation or weight felt by the wearer. In an embodiment, the outer frame 100 may be formed of a synthetic resin material such as reinforced plastic.

The outer frame 100 may be formed in a shape capable of accommodating and protecting the wearer' head and minimizing air resistance during driving. In the exemplary embodiment, the outer frame 100 is a sphere shape similar to the wearer' head.

The visor 200 is rotatably coupled to the outer frame 100. The frame opening 120 communicating with the outside of the accommodation space 110 may be opened or closed by the visor 200.

In particular, as will be described later, the visor 200 according to an embodiment of the present invention includes a main visor 210 mainly performing a function of blocking external air and a sub-visor 220 mainly performing a function of blocking light. The main visor 210 and the sub-visor 220 may be independently moved.

A supporter 300 is coupled to the outer frame 100. The supporter 300 is fixedly coupled to the outer frame 100. The supporter 300 moveably supports the sub-visor 220 through the mover 400.

The mover 400 is coupled to the outer frame 100. Specifically, the mover 400 is movably coupled to the supporter 300 that is fixedly coupled to the outer frame 100. The sub-visor 220 is coupled to the mover 400 to be moved together with the mover 400.

The adjuster 500 is coupled to the outer frame 100. Some components of the adjuster 500 are movably provided and coupled with the mover 400. Therefore, when the above-mentioned some components of the adjuster 500 is manipulated, the mover 400 and the sub-visor 220 coupled thereto may be moved.

In an exemplary embodiment, the outer frame 100 includes the accommodation space 110 and the frame opening 120.

The accommodation space 110 is a space formed inside the outer frame 100. The accommodation space 110 may be formed in a shape corresponding to the wearer' head, and may accommodate the wearer' head. In an exemplary embodiment, the accommodation space 110 may be formed in a spherical shape corresponding to the shape of the outer frame 100.

One side of the accommodation space 110, that is, the lower side in the exemplary embodiment may be opened to receive the head or neck of the wearer. The other side of the accommodation space 110, that is, the front side in the exemplary embodiment, communicate with the frame opening 120.

The frame opening 120 communicates the accommodation space 110 formed inside the outer frame 100 with the outside.

The frame opening 120 forms one side where the outer frame 100 communicates with the outside. In the exemplary embodiment, the frame opening 120 is located on the front side of the outer frame 100.

The frame opening 120 may be opened or covered on the visor 200. Specifically, the frame opening 120 may be entirely covered by the main visor 210. In addition, the frame opening 120 may be partially covered by the sub-visor 220.

In an exemplary embodiment, when the visor 200 rotates clockwise with respect to a right side, the frame opening portion 120 may be opened such that the accommodation space 110 may communicate with the outside.

In addition, when the visor 200 rotates counterclockwise with respect to the right side in the exemplary embodiment, the frame opening 120 is closed to block the communication between the accommodation space 110 and the outside. Of course, even in this case, it is known that the lower side of the outer frame 100 is opened so that the wearer' head may be received in the accommodation space 110.

Figure 3:
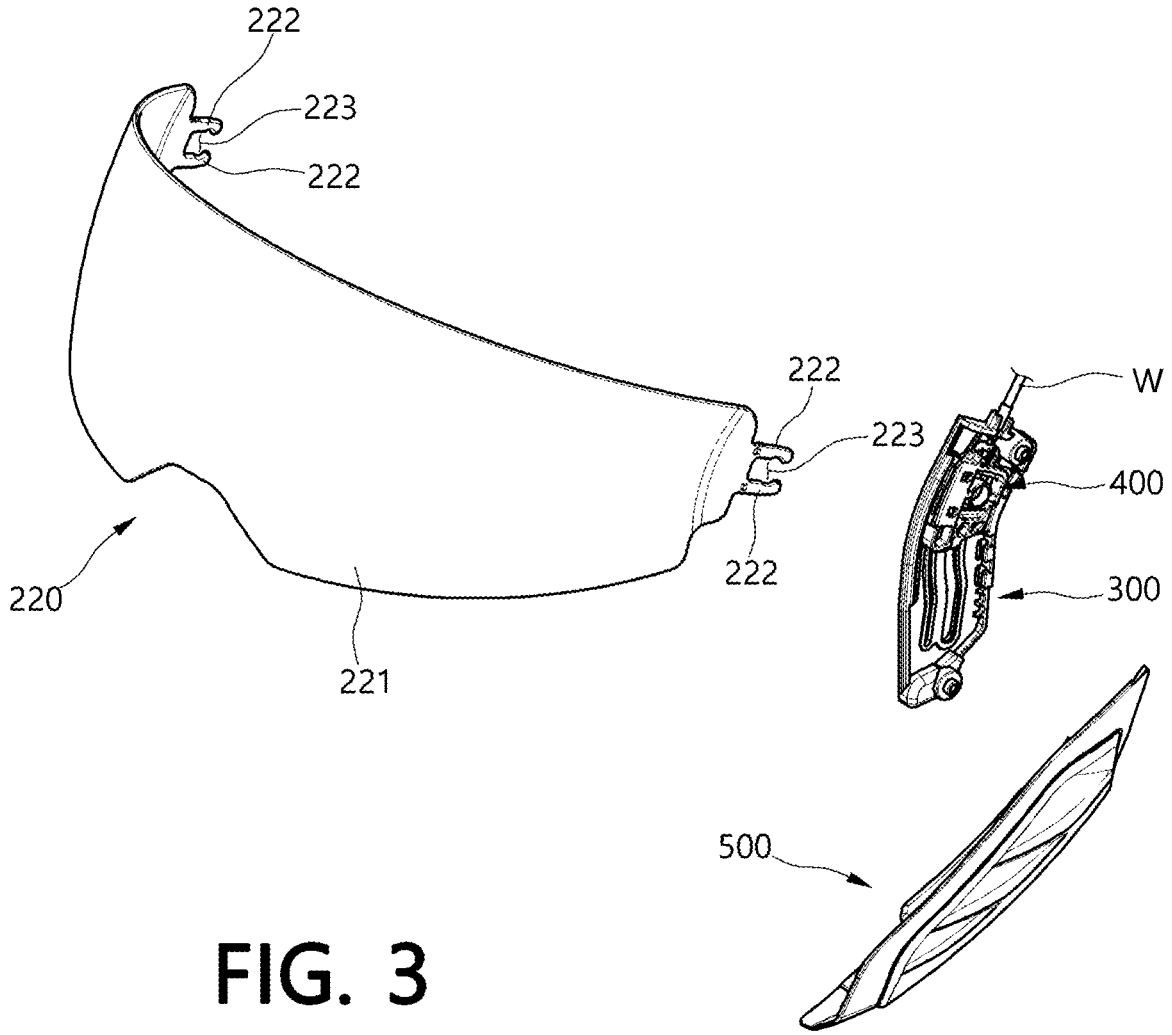
FIG. 3 is an exploded perspective view showing a sub-visor, a supporter, a mover, and an adjuster provided in the head protection gear of FIG. 1.

Referring to FIGS. 1 to 3, the head protection gear 10 according to an embodiment of the present invention includes a visor 200.

The visor 200 is rotatably coupled to the outer frame 100 to open or close the frame opening 120. That is, the visor 200 is formed to partially cover the frame opening 120. During driving, the visor 200 may close the frame opening 120 to prevent external air or foreign substances from flowing into the accommodation space 110 of the head protection gear 10.

The visor 200 may be formed of a lightweight and highly rigid material. In addition, the visor 200 may be formed of a light-transmissive material. In an embodiment, the visor 200 may be formed of a synthetic resin material such as reinforced plastics.

The visor 200 is coupled to the outer frame 100. Specifically, the visor 200 seated on the outer frame 100 is rotatably coupled to the outer frame 100. It is as described above that the frame opening 120 may be opened or closed by rotating the visor 200.

The visor 200 is coupled to the supporter 300. Specifically, the sub-visor 220 provided in the visor 200 is coupled to the mover 400 that is movably coupled to the supporter 300. Accordingly, it may be said that the sub-visor 220 is movably coupled to the supporter 300 via the mover 400.

The visor 200 is coupled to the adjuster 500. Specifically, the sub-visor 220 provided in the visor 200 is coupled to the mover 400 coupled to the adjuster 500. Therefore, it may be said that the sub-visor 220 is coupled to the adjuster 500 via the mover 400.

In an embodiment shown in FIGS. 2 to 3, the visor 200 includes a main visor 210 and a sub-visor 220.

The main visor 210 blocks the communication between the accommodation space 110 and the outside, and prevents the external air in the driving direction flowing into the accommodation space 110. In other words, it may be said that the main function of the main visor 210 is to prevent the inflow of external air.

The main visor 210 is rotatably coupled to the outer frame 100. In an exemplary embodiment, the main visor 210 may rotate clockwise and move upward with respect to the right side. In this state, the frame opening 120 may be opened.

In an exemplary embodiment, the main visor 210 may rotate in a counterclockwise direction and move downward with respect to the right side. In this state, the main visor 210 may close the frame opening 120.

The main visor 210 is disposed to overlap with the sub-visor 220. Specifically, the main visor 210 is located outside the sub-visor 220, and is disposed to cover the sub-visor 220 and the frame opening 120. In other words, the main visor 210 partially overlaps with the sub-visor 220 and is disposed to cover the frame opening 120.

The sub-visor 220 is located between the main visor 210 and the frame opening 120.

The sub-visor 220 blocks or reduces light that passes through main visor 210 and flows into accommodation space 110. Accordingly, the intensity of light passing through the sub-visor 220 and progressing to the eye of the wearer is reduced, and the glare of the wearer may be reduced. As a result, safe driving of the wearer may be possible. To this end, the sub-visor 220 may be formed of a material capable of reducing the intensity of light, or may be coated with the corresponding material.

Accordingly, it may be said that the main function of the sub-visor 220 is to reduce the intensity of light proceeding to the accommodation space 110. In an embodiment, the sub-visor 220 may be referred to as a sun visor.

The sub-visor 220 is movably coupled to the outer frame 100. In an exemplary embodiment, the sub-visor 220 is coupled to the outer frame 100 to be movable upward or downward. The coupling may be achieved by movably coupling the mover 400 coupled to the sub-visor 220 to the supporter 300.

The sub-visor 220 is disposed to partially cover the frame opening 120. As the sub-visor 220 is moved, a portion of the frame opening 120 covered by the sub-visor 220 may be changed.

The sub-visor 220 is located between the main visor 210 and the accommodation space 110. That is, the sub-visor 220 is covered by the main visor 210, and the sub-visor 220 is disposed to cover the accommodation space 110 and the frame opening 120 communicating with the accommodation space 110.

Accordingly, since the sub-visor 220 is not arbitrarily exposed to the outside, damage to the sub-visor 220 due to external foreign substances or the like may be minimized.

The sub-visor 220 is coupled to the adjuster 500 by the mover 400. When the wearer manipulates the adjuster 500, the sub-visor 220 may be moved together with the mover 400. In this case, the movement path of the sub-visor 220 may be formed by the moving groove 320 and the guider 330 formed in the supporter 300.

In an embodiment shown in FIG. 3, the sub-visor 220 includes a sub-visor body 221, a sub-protrusion 222, and a sub-opening 223.

The sub-visor body 221 forms a body of sub-visor 220. The sub-visor body 221 extends to be curved in the width direction of the outer frame 100, that is, in the left and right directions in the exemplary embodiment so as to cover the frame opening 120. In other words, the cross-section of the sub-visor body 221 in the horizontal direction has a rounded arc shape so as to be convex outward.

Each end of the sub-visor body 221 in the extension direction is provided with the sub-protrusion 222 and the sub-opening 223.

The sub-protrusion 222 is a portion where the sub-visor body 221 is coupled to the mover 400. The sub-protrusion 222 is located at an end of the sub-visor body 221 in the extension direction. The sub-protrusion 222 is configured to protrude from the end of the sub-visor body 221 toward the mover 400, that is, toward the rear side in the exemplary embodiment.

The sub-projection 222 may be provided in plural. The plurality of sub-protrusions 222 may be disposed to be spaced apart from each other to form a space therebetween. In the exemplary embodiment, two sub-protrusions 222 are provided and disposed to be spaced apart from each other in the vertical direction. A space formed by the pair of sub-projections 222 spaced apart from each other may be defined as the sub-opening 223.

The pair of sub-protrusions 222 penetrate the coupling opening 441 provided in the mover 400 and are accommodated in a coupling space 442. The pair of sub-protrusions 222 cover a coupling protrusion 443 and are coupled to the coupling protrusion 443. That is, the pair of sub-projections 222 are disposed to surround the coupling protrusion 443 accommodated in the sub-opening 223.

As will be described later, the coupling protrusion 443 may be formed in a cylindrical shape having a circular cross-section. In the embodiment, the inner edges (i.e., each edge facing each other) of the pair of sub-protrusions 222 may be formed to be rounded outward so that the sub-opening 223 may have a shape corresponding to the shape of the coupling protrusion 443.

The pair of sub-projections 222 and the sub-opening 223 may be provided in plural, respectively. The plurality of pairs of sub-projections 222 and the plurality of sub-openings 223 may be disposed at different positions and may be coupled to the mover 400, respectively.

In the exemplary embodiment, two pairs of sub-protrusions 222 and two sub-openings 223 are provided, each located at the left end and the right end of the sub-visor body 221.

Referring again to FIGS. 1 to 3, the head protection gear 10 according to an embodiment of the present invention includes the supporter 300.

The supporter 300 moveably supports the mover 400 and the sub-visor 220 coupled thereto. A moving groove 320 and a guider 330 may be formed inside the supporter 300 to form a movement path of the mover 400 and the sub-visor 220 coupled thereto.

The supporter 300 is coupled to the outer frame 100. The supporter 300 may be accommodated inside the outer frame 100 and may be disposed not to be randomly exposed to the outside. The supporter 300 may be fixedly coupled to the outer frame 100.

The sub-visor 220 of the visor 200 is movably coupled to the supporter 300. It is as described above that the coupling is formed by movably coupling the mover 400 coupled to the sub-visor 220 to the supporter 300.

The supporter 300 may be provided in plural. The plurality of supporters 300 may be coupled to the outer frame 100 at different positions to movably support the plurality of movers 400, respectively.

In an embodiment, a pair of supporters 300 may be provided and disposed on the left and right sides of the outer frame 100, respectively. Each supporter 300 may moveably support a plurality of movers 400 and each end of the sub-visor 220 coupled thereto.

In an embodiment shown in FIGS. 4 to 7, the supporter 300 includes a supporting body 310, a moving groove 320, and a guider 330.

The supporting body 310 forms a body of the supporter 300. The supporting body 310 may be configured to extend in one direction to support the mover 400 moved along the movement path and the sub-visor 220 coupled thereto. In the exemplary embodiment, the supporting body 310 extends in the vertical direction, the upper portion thereof extends inclined toward the rear side, and the lower portion thereof extends perpendicular to the upper portion.

In addition, the supporting body 310 is configured to have a predetermined thickness of the outer frame 100 in the width direction, that is, in the left and right directions in the exemplary embodiment. Therefore, in the exemplary embodiment, it may be said that the supporting body 310 is formed in a polygonal plate shape.

The supporter 300 may have an arbitrary shape capable of movably supporting the mover 400 and forming a movement path of the sub-visor 220.

The supporting body 310 is coupled to the outer frame 100. The supporting body 310 is fixedly connected to the inside of the outer frame 100, so that any random shaking may be prevented.

A moving groove 320 and a guider 330 are disposed inside the supporting body 310.

The moving groove 320 forms a movement path of the movement member 400 coupled to the supporter 300. The mover 400 and the sub-visor 220 coupled thereto may be moved to the height direction of the visor 200, that is, the upper side or the lower side in the exemplary embodiment, along the moving groove 320. The mover 400 is movably coupled to the moving groove 320.

The moving groove 320 is formed through the inside of the supporting body 310. Alternatively, the moving groove 320 may be recessed in the surface of the supporting body 310 toward the mover 400, that is, the outer surface in the exemplary embodiment.

The moving groove 320 may extend along the extension direction of the supporting body 310. In the exemplary embodiment, the moving groove 320 extends in the vertical direction, but is configured to include a curved portion.

The moving groove 320 may be formed in plural. The plurality of moving grooves 320 may be spaced apart from each other, and the movers 400 may be movably coupled to each moving groove. In the exemplary embodiment, two moving grooves 320 are provided, including a first moving groove **320*a* located on the front side and a second moving groove 320*b*** located on the rear side.

The first moving groove **320*a* and the second moving groove 320*b* are disposed to be spaced apart from each other in the width direction of the supporting body 310, that is, the front and rear directions in the exemplary embodiment. The first moving groove 320*a* may be configured to have a smaller width than the second moving groove 320*b***.

The shape and arrangement of the first moving groove **320*a* and the second moving groove 320*b* may be changed depending on the shape and arrangement of the first moving protrusion 421 and the second moving protrusion 422 of the mover 400**.

Figure 7:
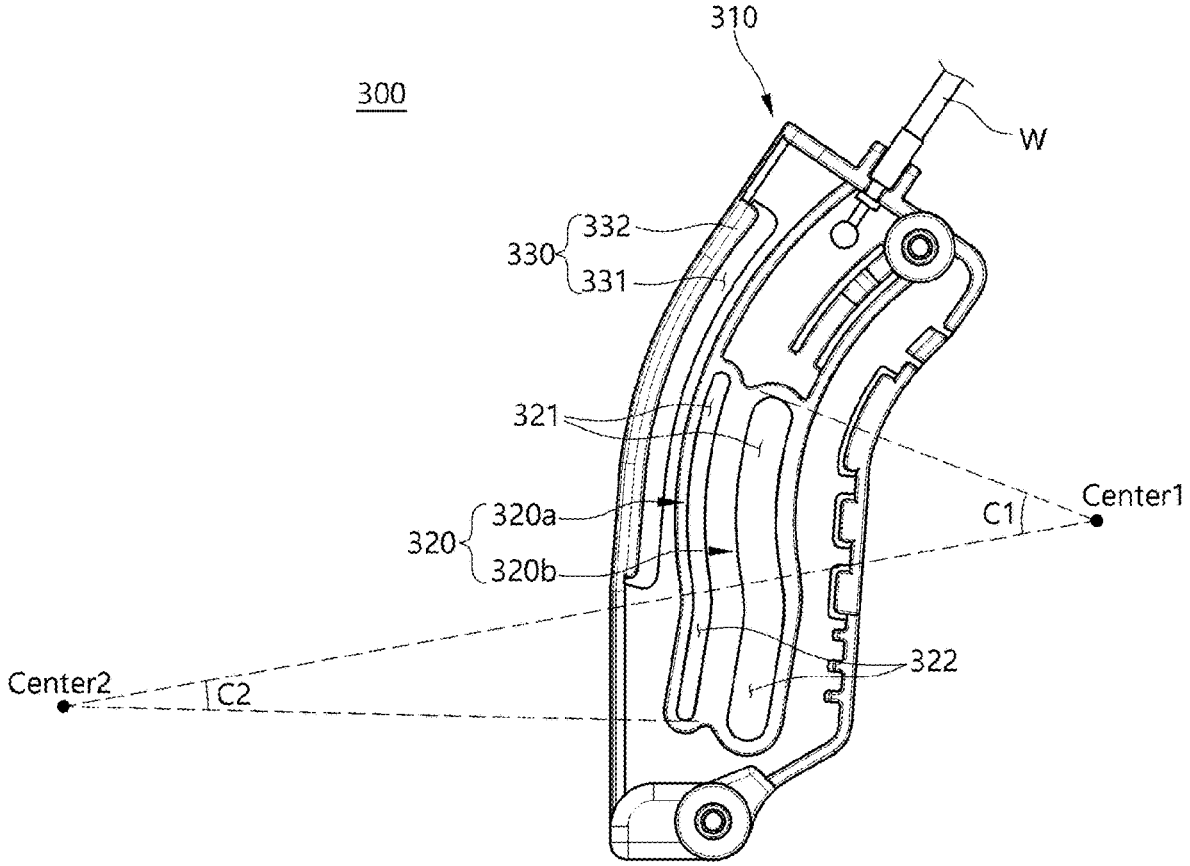
FIG. 7 is a side view showing the supporter of FIG. 4.

The moving groove 320 may be divided into a plurality of portions. The plurality of portions constituting the moving groove 320 may be formed to have different centers and curvatures. As best shown in FIG. 7, the moving groove 320 includes a first extension 321 and a second extension 322.

The first extension 321 forms a portion of the moving groove 320. In the exemplary embodiment, the first extension 321 forms an upper portion of the moving groove 320.

The first extension 321 may be curved and extended with a predetermined curvature. The first extension 321 has its center, that is, a first center Center1 on one side of the supporting body 310 in the width direction, that is, on the rear side in the exemplary embodiment, and has a curved shape that is curved and extended with the first curvature C1. In the embodiment, the first center Center1 may be located on the rear side of the outside of the supporting body 310.

The first extension 321 is continuous with the second extension 322. The first extension 321 and the second extension 322 communicate with each other.

The second extension 322 forms another portion of the moving groove 320. In the exemplary embodiment, the second extension portion 322 forms a lower portion of the moving groove 320.

The second extension 322 may be curved and extended with a predetermined curvature. The second extension 322 has its center, that is, the second center Center2 on the other side in the width direction, that is, on the front side in the exemplary embodiment, and has a curved shape that is curved and extended with the second curvature C2. In an embodiment, the second center Center2 may be located on the front side of the outside of the supporting body 310.

In an embodiment, the first curvature C1 of the first extension 321 may be different from the second curvature C2 of the second extension 322. In other words, in the embodiment, the first extension 321 and the second extension 322 may be bent and extended to different degrees.

In an embodiment, the first curvature C1 of the first extension 321 may be configured to be greater than the second curvature C2 of the second extension 322. In other words, in the embodiment, the first extension 321 may be bent and extended than the second extension 322.

In an embodiment, the first curvature C1 of the first extension 321 or the second curvature C2 of the second extension 322 may be zero. That is, in the embodiment, the first extension 321 or the second extension 322 may extend straight in a straight line shape.

Therefore, the mover 400 moved along the first extension 321 and the second extension 322 and the movement path of the sub-visor 220 coupled thereto may be variously formed.

As described above, the first center Center1 of the first extension 321 and the second center Center2 of the second extension 322 may be disposed in opposite directions. That is, the first center Center1 and the second center Center2 may be disposed to face each other with the supporting body 310 interposed therebetween.

Accordingly, the first extension 321 and the second extension 322 may be configured to be rounded in different directions, respectively, that is, to be convex toward the front side and the rear side in the exemplary embodiment. As a result, the mover 400 moving along the first extension 321 and the second extension 322 and the sub-visor 220 coupled thereto may be moved while changing the direction at least once.

The guider 330 moveably supports the mover 400 coupled to the moving groove 320. The mover 400 may be moved while being maintained in a state coupled to the moving groove 320 by the guider 330.

The guider 330 is disposed on the supporting body 310. The guider 330 is disposed to be spaced apart from the moving groove 320. In the exemplary embodiment, the guider 330 is disposed on the front side of the moving groove 320 and is located adjacent to the front side edge of the supporting body 310.

The guider 330 may extend along the movement path of the mover 400. As described above, the moving groove 320 forming the movement path of the mover 400 is figured to extend in the vertical direction, and the guider 330 also extends in the vertical direction.

In this case, the guider 330 may be configured to have a different shape from the moving groove 320. That is, as described above, the moving groove 320 includes a first extension 321 having a first center Center1 and a second extension 322 having a second center Center2 in opposite directions.

On the other hand, the guider 330 may be configured to have a single center located outside the supporting body 310. In the exemplary embodiment, the guider 330 is rounded to be convex toward the front side, and it will be understood that the center of the guider 330 is located on the rear side of the supporting body 310.

In addition, the guider 330 may be located such that each end in the extension direction thereof is inclined to one side relative to each end in the extension direction of the moving groove 320. In other words, in the exemplary embodiment, the upper and lower ends of the guider 330 are located to be inclined upwardly relative to the upper and lower ends of the moving groove 320, respectively.

Therefore, the mover 400 coupled to the moving groove 320 and the guider 330, respectively, may be moved along the movement path but may be rotated by a predetermined angle due to the different shapes of the moving groove 320 and the guider 330.

In an exemplary embodiment, the guider 330 includes a guide groove 331 and a guide edge 332.

The guide groove 331 is coupled to the guide protrusion 430 of the mover 400. The guide groove 331 may be formed through the inside of the supporting body 310, and the guide protrusion 430 may be coupled therethrough. Alternatively, the guide groove 331 may be recessed on the outer surface of the supporting body 310 to accommodate the guide protrusion 430.

The guide groove 331 extends in the extension direction of the supporting body 310, that is, in the vertical direction in the exemplary embodiment. In this case, it is as described above that the guide groove 331 may be formed in a curved shape having a single center.

A guide edge 332 is disposed adjacent to the guide groove 331.

The guide edge 332 supports the guide protrusion 430 (i.e., of the mover 400) coupled to the guide groove 331 from the outside.

The guide edge 332 is formed to partially cover the guide groove 331. In the exemplary embodiment, the guide edge 332 may be extended from the front side of the guide groove 331 toward the rear side to cover the front side of the guide groove 331.

The guide edge 332 extends along the extension direction of the guide groove 331. In the exemplary embodiment, the guide edge 332 extends in the vertical direction like the guide groove 331 but is formed in a curved shape having a single center located outside the supporting body 310.

Therefore, the guide protrusion 430 may be inserted into the guide groove 331 or drawn out of the guide groove 331 only when the guide protrusion 430 is manipulated at a predetermined angle. Accordingly, the arbitrary separation of the guide protrusion 430 is prevented, and the coupling between the guide groove 331 and the guide protrusion 430 may be stably maintained.

Referring again to FIGS. 1 to 3, the head protection gear 10 according to an embodiment of the present invention includes a mover 400.

The mover 400 is movably coupled to the supporter 300. The sub-visor 220 may be coupled to the mover 400 to be moved together with the mover 400.

The mover 400 is coupled to the outer frame 100. Specifically, the mover 400 is movably coupled to the supporter 300 fixedly coupled to the outer frame 100. Therefore, it may be said that the mover 400 is movably coupled to the outer frame 100 via the supporter 300.

The mover 400 is coupled to the sub-visor 220. Specifically, the sub-projection 222 and the sub-opening 223 located at an end of the sub-visor 220 are coupled to the mover 400. The coupled sub-visor 220 may be moved along with the mover 400.

The mover 400 is movably coupled to the supporter 300. The mover 400 may be coupled to the moving groove 320 and moved along the moving groove 320, but may also be coupled to the guider 330 to guide the movement.

The mover 400 is coupled to the adjuster 500. Specifically, the mover 400 may be coupled to the adjuster 500 through the wire W and moved by being pressed or pulled according to the operation of the adjuster 500.

The mover 400 may be provided in plural. The plurality of movers 400 may be coupled to the plurality of sub-projections 222, sub-opening 223, the plurality of supporters 300, and the adjuster 500, respectively.

In an embodiment, two movers 400 may be provided and coupled to a pair of supporters 300 located on the left and right sides, respectively. The two movers 400 may be coupled to the sub-projections 222 and the sub-opening 223 located at each end of the sub-visor 220 in the extension direction.

Figure 4:
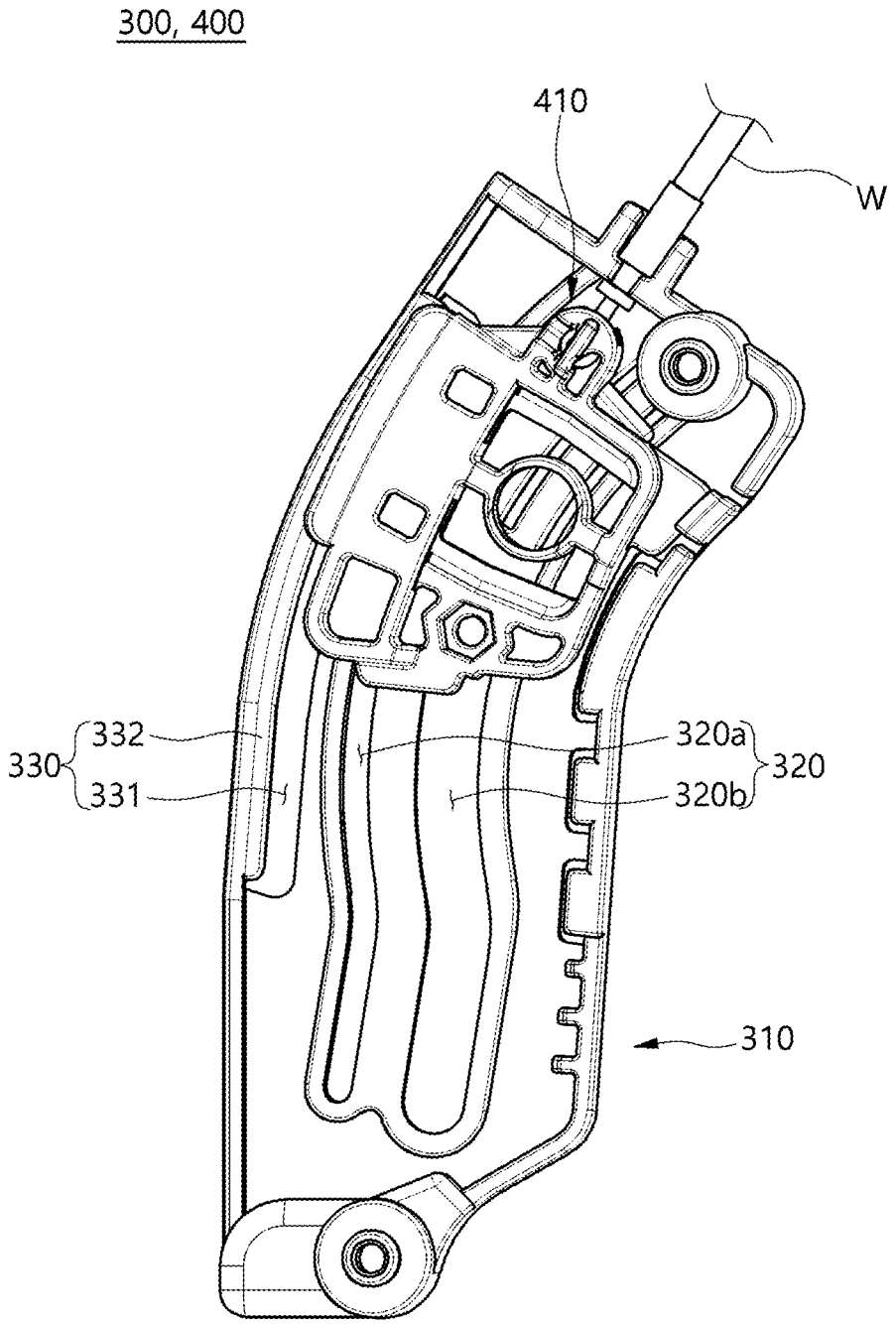
FIG. 4 is a side view showing a supporter and a mover provided in the head protection gear of FIG. 1.
Figure 5:
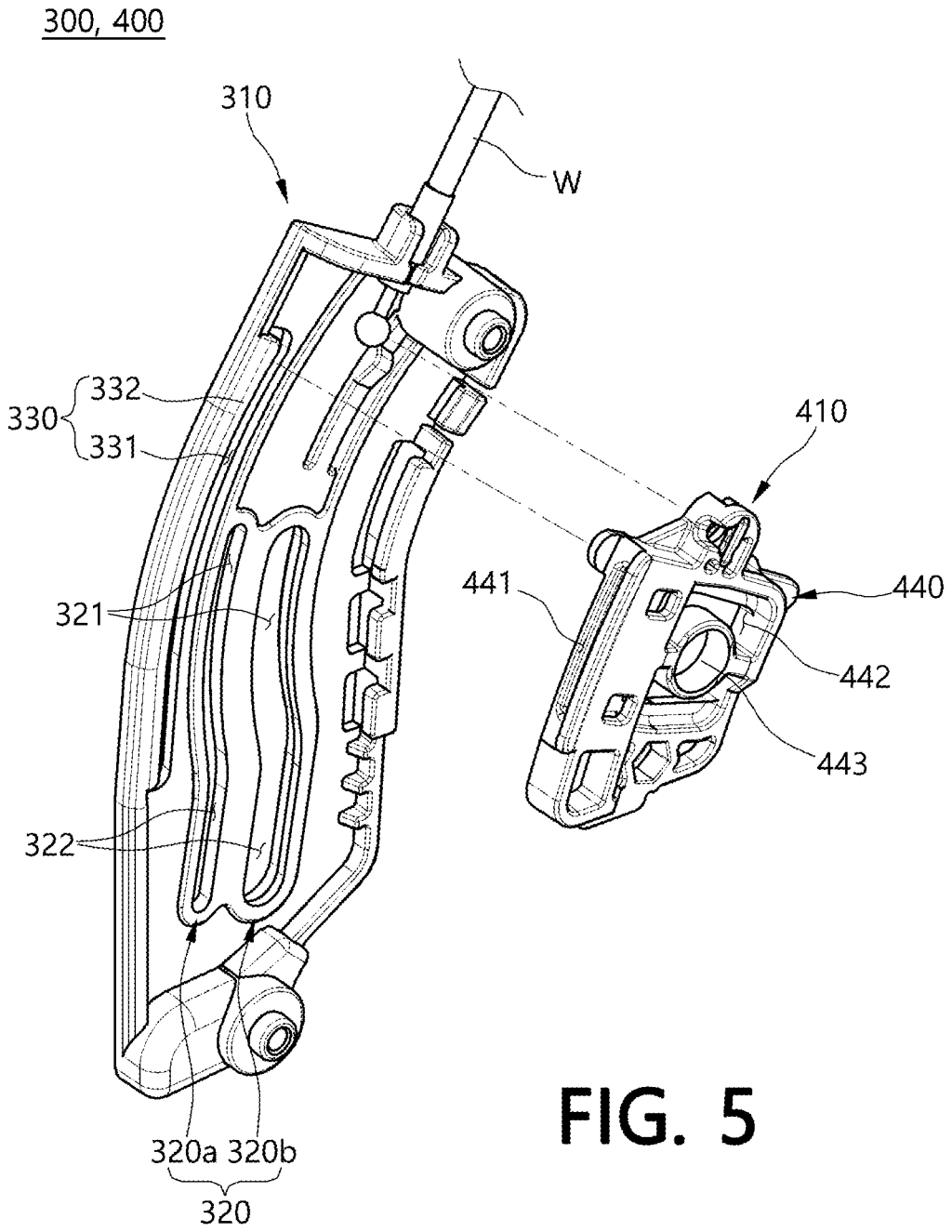
FIGS. 5 and 6 are exploded perspective views showing the supporter and the mover of FIG. 4.
Figure 6:
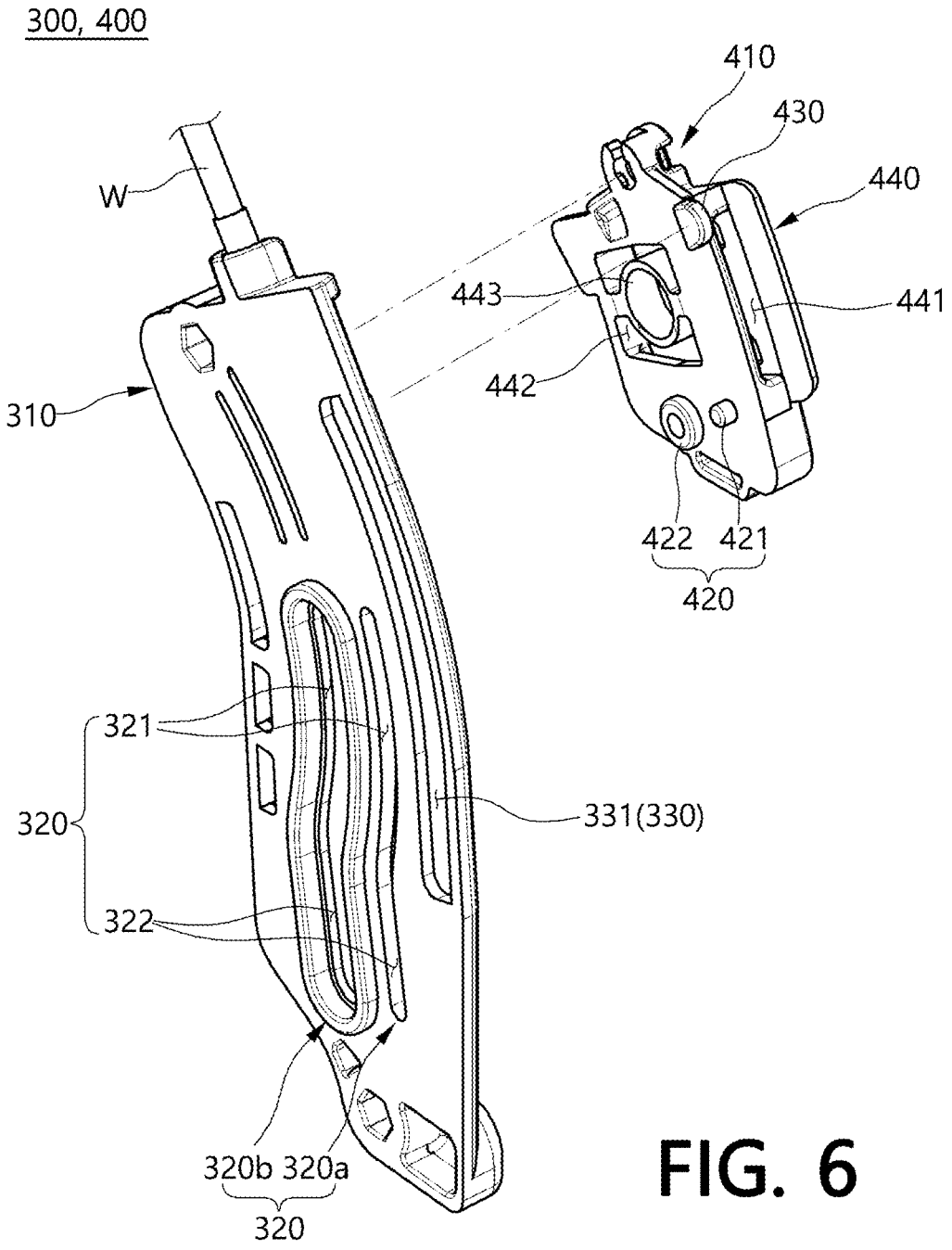

In an embodiment shown in FIGS. 4 to 6, the mover 400 includes a moving body 410, a moving protrusion 420, a guide protrusion 430, and a visor coupler 440.

The moving body 410 forms a body of the mover 400. The moving body 410 is movably coupled to the supporter 300. Specifically, the moving body 410 may be moved in the extension direction of the supporting body 310, that is, in the vertical direction in the exemplary embodiment, along the moving groove 320 formed in the supporting body 310.

The moving body 410 may be configured to have a smaller size than the supporting body 310. Therefore, even if the moving body 410 is moved while being coupled to the supporting body 310, the area in which the moving body 410 is exposed to the outside of the supporting body 310 along the moving direction may be minimized.

Therefore, the moving body 410 may be moved without interfering with other components provided in the outer frame 100 or being interfered by the other components.

The moving body 410 is coupled to the moving protrusion 420. The moving body 410 may be movably coupled to the supporter 300 through the moving protrusion 420.

The moving body 410 is coupled to the guide protrusion 430. The movement of the moving body 410 may be guided by the guide protrusion 430.

A visor coupler 440 is formed inside the moving body 410. The moving body 410 may be coupled to the sub-visor 220 by the visor coupler 440.

The moving body 410 may be coupled to the sub-visor 220 and may have an arbitrary shape capable of moving along the supporter 300. In an exemplary embodiment, the moving body 410 has a polygonal cross-section including a plurality of edges, and is configured to have a width direction of the supporter 300, that is, a thickness in the left and right directions in the exemplary embodiment.

The moving body 410 is coupled to a wire W. Therefore, when the wire W is pulled or pressed, the mover 400 and the sub-visor 220 coupled thereto may be moved to the upper side or the lower side.

The moving protrusion 420 is formed on one surface of the moving body 410 toward the supporter 300, that is, on the left side in the exemplary embodiment.

The moving protrusion 420 is a portion where the mover 400 is coupled to the moving groove 320. In an embodiment, the moving protrusion 420 may be inserted into and coupled to the moving groove 320. In an embodiment in which the moving groove 320 is formed to be penetrated, the moving protrusion 420 may be penetratively coupled to the moving groove 320.

The moving protrusion 420 is configured to protrude from the surface of the moving body 410 toward the supporter 300. In an exemplary embodiment, the moving protrusion 420 is located on the inner surface of the moving body 410 toward the supporter 300.

The moving protrusion 420 may have an arbitrary shape that may be movably coupled to the moving groove 320. In an exemplary embodiment, the moving protrusion 420 has a circular cross-section having a diameter equal to or less than the width of the moving groove 320, and has a cylindrical shape extending in the direction toward the supporter 300, that is, toward the inside.

In this case, the distance by which the mover 400 is coupled to the supporter 300 to be moved may be determined according to the relative position of the moving protrusion 420 and the moving groove 320.

That is, the movement distance of the mover 400 in one direction, that is, the movement distance to the upper side in the exemplary embodiment, may be defined as a distance until the moving protrusion 420 is in contact with the upper end of the moving groove 320. Likewise, the movement distance of the mover 400 in the other direction, that is, the movement distance to the lower side in the exemplary embodiment, may be defined as a distance until the moving protrusion 420 is in contact with the lower end of the moving groove 320.

The moving protrusion 420 may be provided in plural. The plurality of moving protrusions 420 may be movably coupled to the plurality of moving grooves 320, respectively. In the exemplary embodiment, two moving protrusions 420 are provided, including a first moving protrusion 421 and a second moving protrusion 422.

The first moving protrusion 421 is movably coupled to the first moving groove 320*a*. The second moving protrusion 422 is movably coupled to the second moving groove 320*b*. Therefore, it will be understood that the shape and arrangement of the first moving protrusion 421 and the second moving protrusion 422 may be changed according to the shape and arrangement of the first moving groove 320*a* and the second moving groove 320*b*.

The guide protrusion 430 is movably coupled to the guider 330 of the supporter 300 to guide the movement of the mover 400. By the coupling between the guide protrusion 430 and the guider 330, the idle rotation of the mover 400 may be prevented. Accordingly, the mover 400 may be reliably moved in a state where it is coupled to the supporter 300.

The guide protrusion 430 is continuous with the moving body 410. The guide protrusion 430 is located at one edge of the one surface of the moving body 410 on which the moving protrusion 420 is formed, that is, the left surface in the exemplary embodiment. In the exemplary embodiment, the guide protrusion 430 is located at a front side edge of the one surface of the moving body 410.

The guide protrusion 430 is configured to protrude outward from one edge of the moving body 410, that is, the front side edge in the exemplary embodiment. In the exemplary embodiment, the guide protrusion 430 protrudes toward the front side.

The guide protrusion 430 is movably coupled to the guide groove 331. In an embodiment, the guide protrusion 430 may be movably inserted and coupled to the guide groove 331. In an embodiment in which the guide groove 331 is formed to be penetrated, the guide protrusion 430 may be penetratively coupled to the guide groove 331.

The outer surface of the guide protrusion 430 movably coupled to the guide groove 331 is supported by the guide edge 332. In the exemplary embodiment, the right-facing surface of the guide protrusion 430 is supported by the guide edge 332. Accordingly, the guide protrusion 430 may be coupled to or separated from the guide groove 331 only in a predetermined direction or angle.

Accordingly, the coupling state of the guide protrusion 430 coupled to the guide groove 331 may be stably maintained.

The guide protrusion 430 may be movably coupled to the guider 330 to have an arbitrary shape capable of guiding the movement of the moving member 400. In the exemplary embodiment, the guide protrusion 430 is rounded so that the outer end is convex outward, and the inner end is flat.

The visor coupler 440 is a portion to which the sub-visor 220 is coupled. The visor coupler 440 supports the sub-visor 220. Accordingly, the sub-visor 220 may be elevated in the vertical direction together with the mover 400.

The visor coupler 440 is formed inside the moving body 410. The visor coupler 440 communicates with the inside and the outside of the moving body 410 so that the sub-visor 220 may be inserted into and coupled to the mover 400.

In an exemplary embodiment, the visor coupler 440 includes a coupling opening 441, a coupling space 442, and a coupling protrusion 443.

The coupling opening 441 forms a passage through which the sub-visor 220 proceeds to the coupling space 442. The coupling opening 441 is openly formed on one side of the moving body 410 to communicate the coupling space 442 with the outside. In the exemplary embodiment, the coupling opening 441 is recessed on the front side surface of the moving body 410.

The sub-protrusion 222 of the sub-visor 220 penetrates the coupling opening 441. As described above, the sub-protrusions 222 disposed at each end of the sub-visor 220 may be provided in pairs and spaced apart from each other. Therefore, the coupling opening 441 configured to extend by a predetermined length in the direction in which the pair of sub-projections 222 are spaced apart, that is, in the vertical direction in the exemplary embodiment.

The coupling opening 441 communicates with the coupling space 442. The sub-protrusion 222 passing through the coupling opening 441 may proceed to the coupling space 442.

The coupling space 442 is a space accommodating the sub-protrusion 222. The coupling space 442 is formed inside the moving body 410. In an embodiment, the coupling space 442 is configured to penetrate in the thickness direction of the moving body 410, that is, in the left and right directions in the exemplary embodiment.

The coupling space 442 communicates with the coupling opening 441. In the exemplary embodiment, the front side of the coupling space 442 communicates with the coupling opening 441.

A coupling protrusion 443 is located inside the coupling space 442.

The coupling protrusion 443 is accommodated in the sub-opening 223 that is a space formed between the pair of sub-protrusions 222. The coupling protrusion 443 is configured to support the pair of sub-protrusions 222 that are disposed to face each other with the sub-opening 223 interposed therebetween.

The coupling projection 443 may be formed corresponding to the shape of each edge where the pair of sub-protrusions 222 face each other. In the exemplary embodiment, the coupling protrusion 443 has a circular cross-section and has a cylindrical shape with a height in the thickness direction of the moving body 410, that is, in the left and right directions.

The coupling protrusion 443 may be supported by coupling ribs (not designated by reference numeral). In the exemplary embodiment, the front side and the rear side of the coupling protrusion 443 are supported by the coupling ribs (not designated by reference numeral), respectively, and are coupled to the inner circumferential surface of the moving body 410.

Accordingly, the sub-protrusion 222 coupled to the coupling protrusion 443 may be supported to prevent arbitrary rotation of the sub-visor 220.

Figure 8:
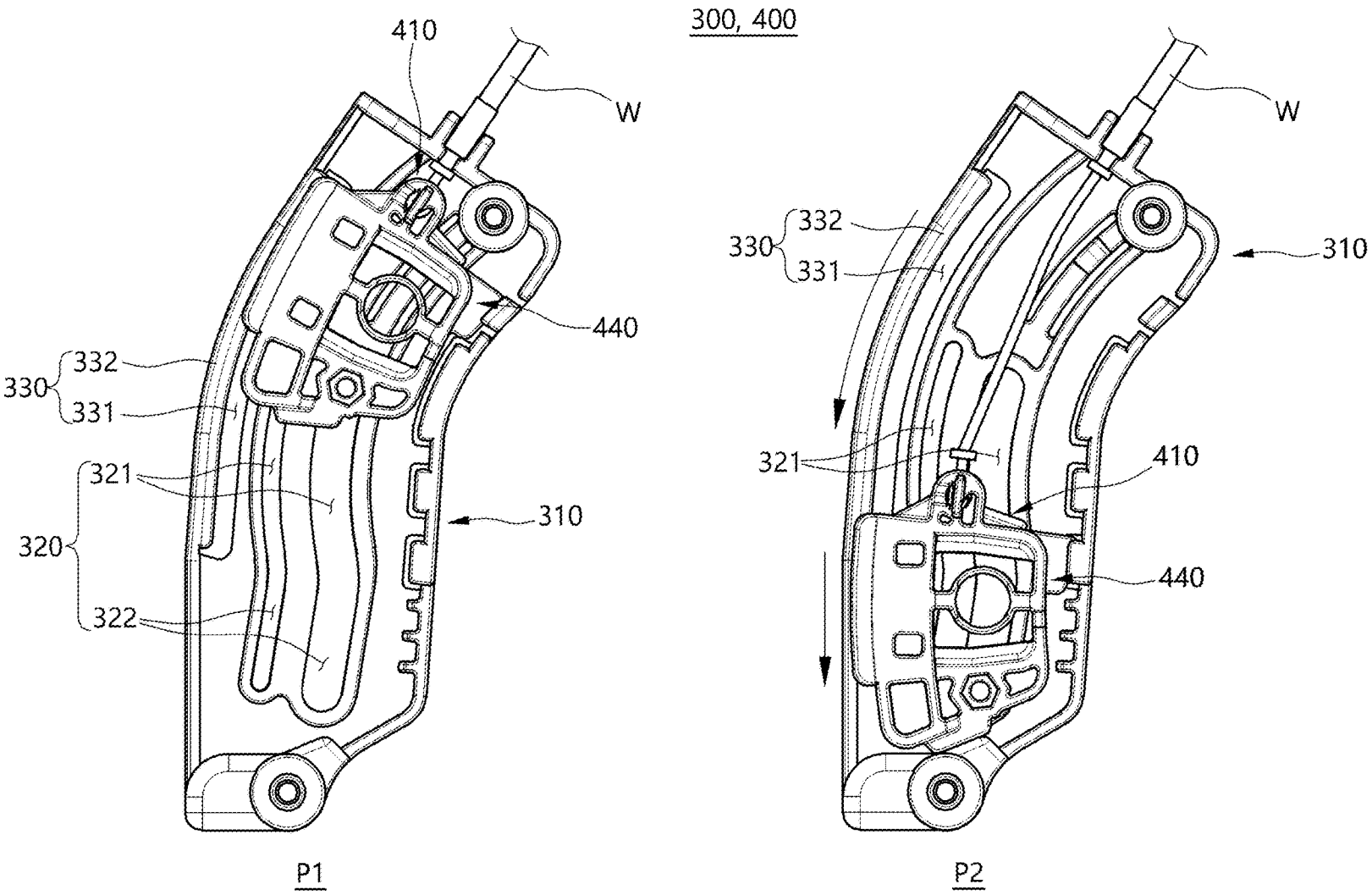
FIG. 8 is a side view showing a case where a position relationship between the supporter of FIG. 4 and the mover coupled thereto is a first position (a) and a second position (b).

Referring to FIG. 8, a moving process of the mover 400 coupled to the supporter 300 is shown.

Referring to (a) of FIG. 8, a state in which the mover 400 is moved maximally upward is shown. The position shown may be defined as a first position P1. It will be understood that at the first position P1, the sub-visor 220 coupled to the moving member 400 is also maximally moved upwards to minimize the area covering the frame opening 120.

Referring to (b) of FIG. 8, a state in which the mover 400 is moved maximally downward is shown. The position shown may be defined as a second position P2. It will be understood that at the second position P2, the sub-visor 220 coupled to the moving member 400 is also maximally moved downwards to maximize the area covering the frame opening 120.

The first position P1 and the second position P2 may be formed by adjusting the adjuster 500 coupled to the mover 400 through the wire W. In this case, the distance at which the adjuster 500 pulls or presses the wire W may be adjusted in multiple stages.

Therefore, the wearer may easily position the sub-visor 220 at a desired height without finely adjusting the adjuster 500. Accordingly, the convenience of the wearer may be improved.

Referring again to FIGS. 2 and 3, the head protection gear 10 according to an embodiment of the present invention includes an adjuster 500.

The adjuster 500 is coupled to the mover 400 via a wire W. The adjuster 500 is operated by an external force to press or pull the wire W. Accordingly, the movable member 400 and the sub-visor 220 coupled thereto may be moved upward or downward, and the position of the sub-visor 220 may be adjusted.

The adjuster 500 is coupled to the outer frame 100. Specifically, the adjuster 500 is located at a portion of the outer frame 100 that partially surrounds the frame opening 120, that is, at the front side end in the exemplary embodiment. In the exemplary embodiment, the adjuster 500 is located adjacent to the lower end of the front right side of the outer frame 100.

In this case, the adjuster 500 may be partially exposed to the outside of the outer frame 100. In other words, one configuration of the adjuster 500 are disposed inside the outer frame 100, and the other configuration of the adjuster 500 are disposed outside the outer frame 100. The wearer may grip and manipulate the other configuration of the adjuster 500.

The adjuster 500 is coupled to the mover 400. Specifically, the adjuster 500 is coupled to the mover 400 through the wire W. As described above, it may be said that as the mover 400 is coupled to the sub-visor 220, the adjuster 500 is coupled to the sub-visor 220 via the mover 400.

Figure 9:
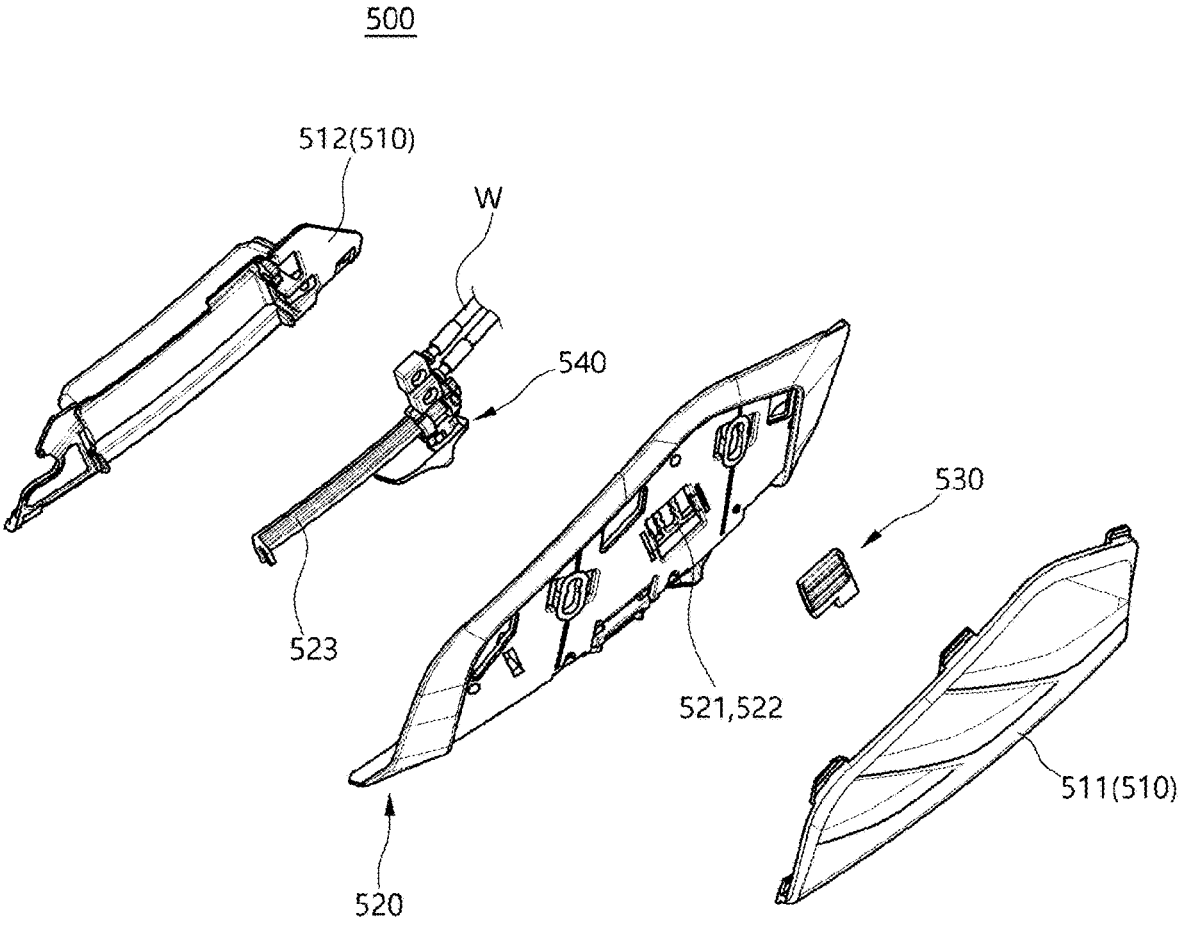
FIG. 9 is an exploded perspective view showing a configuration of the adjuster provided in the head protection gear of FIG. 1.
Figure 10:
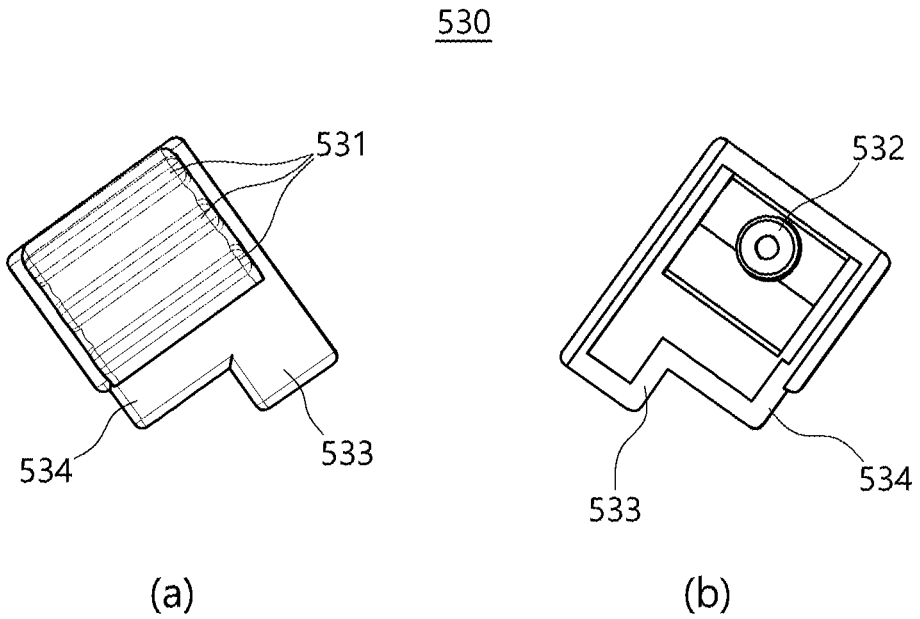
FIG. 10 is a perspective view showing a multi-stage adjuster provided in the adjuster of FIG. 9.
Figure 11:
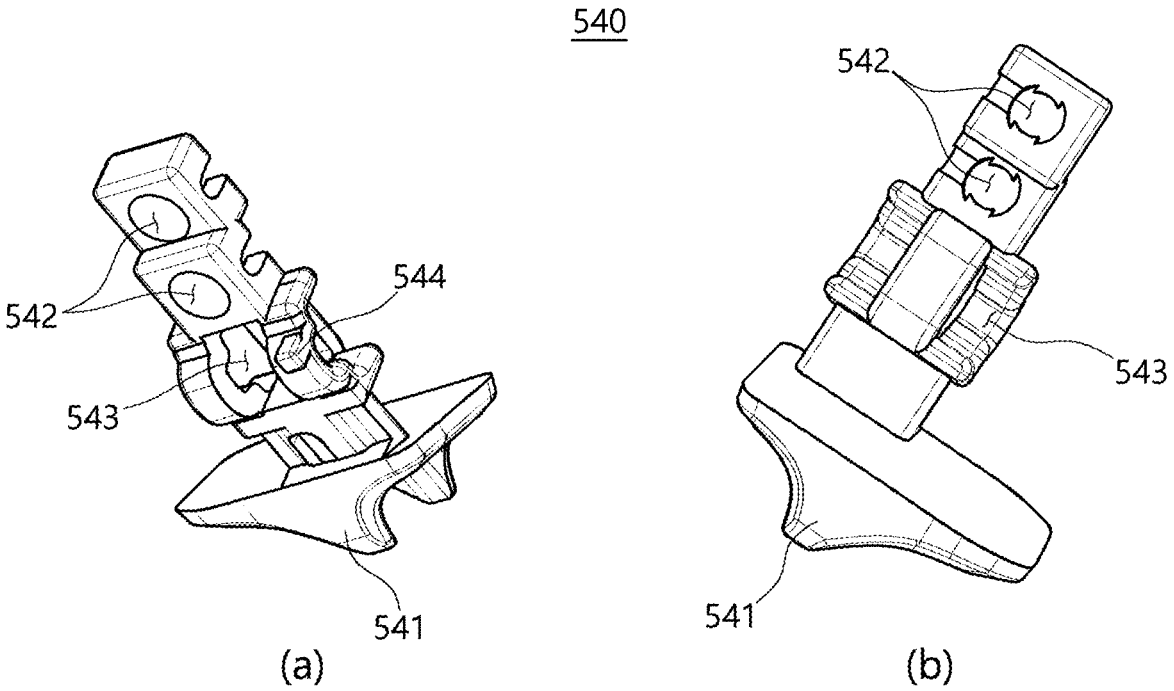
FIG. 11 is a perspective view showing a moving adjuster provided in the adjuster of FIG. 9.

In an embodiment shown in FIGS. 9 to 11, the adjuster 500 includes a cover 510, an adjusting body 520, a multi-stage adjuster 530, and a moving adjuster 540.

The cover 510 forms the outer side of the adjuster 500. The cover 510 is configured to at least partially cover the other configuration of the adjuster 500. Some of the other configuration of the adjuster 500 may be exposed to the outside of the cover 510 and may be gripped and manipulated by the wearer. Another portion of the other configuration of the adjuster 500 may be accommodated inside the cover 510.

The cover 510 is coupled to the adjusting body 520. The cover 510 covers some configuration of the adjuster 500 coupled to the adjusting body 520 and is coupled to the adjusting body 520.

The cover 510 may be coupled to the adjusting body 520 to have an arbitrary shape capable of supporting some configuration of the adjuster 500. In the exemplary embodiment, the cover 510 is configured to extend in the front and rear directions, and some edge extends inclined. The extension direction of the cover 510 corresponds to the extension direction of the adjusting body 520 and the movement direction of the moving adjuster 540 to be described later.

The cover 510 may be provided in plural. The plurality of covers 510 may be coupled to the adjusting body 520 at different positions, respectively. In the exemplary embodiment, the cover 510 includes a first cover 511 coupled with the adjusting body 520 from the outside and a second cover 512 coupled with the adjusting body 520 from the inside. The first cover 511 and the second cover 512 are disposed to face each other with the adjusting body 520 interposed therebetween.

In this case, the first cover 511 is a portion where the adjuster 500 is exposed to the outside. Therefore, it is preferable that the first cover 511 is formed in a shape in which air resistance generated during driving may be minimized.

In addition, the first cover 511 may be detachably coupled to the adjusting body 520. Accordingly, the wearer may manipulate the multi-stage adjuster 530 after removing the first cover 511.

The adjusting body 520 forms a body of the adjuster 500. The adjusting body 520 is coupled to the cover 510 to moveably support the other configuration of the adjuster 500.

The adjusting body 520 may be formed in a shape corresponding to the shape of the cover 510. In the exemplary embodiment, the adjusting body 520 extends in the front and rear directions, and some edge extends inclined.

In other words, the adjusting body 520 is configured to have a length in the front and rear directions and a height in the vertical direction, and the length in the front and rear directions is longer than the height in the vertical direction.

In this case, the extension direction of the adjusting body 520, that is, the front and rear directions, may correspond to the direction in which the moving adjuster 540 is moved. In addition, the height direction of the adjusting body 520, that is, the vertical direction, may correspond to the direction in which the multi-stage adjuster 530 is moved.

The adjusting body 520 is coupled to the multi-stage adjuster 530. The adjusting body 520 moveably supports the multi-stage adjuster 530. In an embodiment, the adjusting body 520 may be coupled to the multi-stage adjuster 530 so that the multi-stage adjuster 530 may be lifted in the height direction.

The adjusting body 520 is coupled to the moving adjuster 540. The adjusting body 520 moveably supports the moving adjuster 540. In an embodiment, the adjusting body 520 may be coupled to the moving adjuster 540 so that the moving adjuster 540 is movable in the longitudinal direction.

In the exemplary embodiment, the adjusting body 520 includes an adjusting penetration 521, a stage adjuster 522, and a guide extension 523.

The adjusting penetration 521 moveably accommodates the multi-stage adjuster 530. As described above, the multi-stage adjuster 530 may be coupled to the adjusting body 520 to be lifted, and the adjusting penetration 521 may be said to accommodate the multi-stage adjuster 530 to be lifted.

The adjusting penetration 521 is recessed inside the adjusting body 520. In an embodiment, the adjusting penetration 521 may be formed in a thickness direction of the adjusting body 520, that is, in the left and right directions in the exemplary embodiment.

The adjusting penetration 521 may be formed in a shape corresponding to the shape of the multi-stage adjuster 530. In the exemplary embodiment, the adjusting penetration 521 is configured to have a quadrangular cross-section with a width in the front and rear directions and a height in the vertical direction, corresponding to the shape of the multi-stage adjuster 530.

At this time, the length, that is, the height, in the vertical direction of the adjusting penetration 521 may be formed to be greater than or equal to the height of the multi-stage adjuster 530. Accordingly, the multi-stage adjuster 530 accommodated in the adjusting penetration 521 may be moved between the first state S1, the second state S2, and the third state S3.

Therefore, it may be said that the adjusting penetration 521 forms a predetermined path for the multi-stage adjuster 530 to be moved.

The adjusting penetration 521 may be located to be biased to one side of the extension direction of the adjusting body 520. In the exemplary embodiment, the adjusting penetration 521 is located biased to the rear side of the adjusting body 520.

A stage adjuster 522 is provided inside the adjusting penetration 521.

The stage adjuster 522 moveably accommodates the adjusting protrusion 532 of the multi-stage adjuster 530. The multi-stage adjuster 530 may be moved along the extension direction, that is, the height direction, of the adjusting penetration 521 while the adjusting protrusion 532 is coupled to the stage adjuster 522.

The stage adjuster 522 may be configured to have a plurality of spaces communicating with each other. In this case, a portion in which the plurality of spaces communicate may be formed to be smaller than the width of each space. In other words, the stage adjuster 522 may be formed in the shape of snowman.

In the exemplary embodiment, the stage adjuster 522 includes three spaces that are continuous in the extension direction of the adjusting penetration 521, that is, in the vertical direction. Each of the three spaces is formed to have a circular cross-section, so that a portion in which each pair of spaces disposed adjacent to each other among the three spaces is formed to be smaller than the width of the three spaces.

Therefore, the state in which the adjusting protrusion 532 is accommodated in any one space of the stage adjuster 522 can be stably maintained. In addition, when an external force (i.e., a direction toward an upper side or a lower side) of a predetermined magnitude or more is applied to the multi-stage adjuster 530, the adjusting protrusion 532 may be moved from the one space to another space.

Accordingly, the multi-stage adjuster 530 may be lifted in the extension direction of the adjusting penetration 521, that is, in the vertical direction.

The shape of the space of the stage adjuster 522 may be formed to correspond to the shape of the adjusting protrusion 532. In the exemplary embodiment, the step adjuster 522 has a circular cross-section, and is formed as a space penetrated in the penetration direction of the adjusting penetration 521, that is, in the left and right directions.

Detailed descriptions of the process of stepwise adjusting the height of the adjusting protrusion 532 and the multi-stage adjuster 530 coupled to the stage adjuster 522 will be described later.

The guide extension 523 moveably supports the moving adjuster 540 movably coupled to the adjusting body 520. The guide extension 523 extends in the longitudinal direction of the adjusting body 520, that is, in the front and rear directions in the exemplary embodiment.

The guide extension 523 forms the other portion accommodated inside the outer frame 100 among the configuration of the adjuster 500. The guide extension 523 is coupled to one surface, that is, the inner surface, facing the second cover 512 among the surfaces of the adjusting body 520. In the exemplary embodiment, the guide extension 523 is coupled to the left side of the adjusting body 520. The guide extension 523 is disposed to cover the second cover 512.

The multi-stage adjuster 530 limits the movement distance of the moving adjuster 540 that is movably coupled to the guide extension 523. The distance at which the moving adjuster 540 is moved by the multi-stage adjuster 530 may be limited to multi-stages.

The wearer may position the sub-visor 220 at a preset position only by manipulating the multi-stage adjuster 530 and moving the moving adjuster 540 until it comes into contact with the multi-stage adjuster 530. Accordingly, since the operation for positioning the sub-visor 220 at a specific height becomes simple, the convenience of the wearer may be improved.

The multi-stage adjuster 530 is movably coupled to the adjusting body 520. Specifically, the multi-stage adjuster 530 is coupled to the adjusting penetration 521 and the stage adjuster 522 to be lifted or lowered. In other words, the multi-stage adjuster 530 is coupled to the adjusting penetration 521 and the stage adjuster 522 so as to be movable in the extension direction of the adjusting penetration 521, that is, in the vertical direction in the exemplary embodiment.

As described above, the stage adjuster 522 may include a plurality of spaces that are continuous with each other. The multi-stage adjuster 530 may be maintained in a state in which the adjusting protrusion 532 is coupled to any one of the plurality of spaces.

Therefore, in the exemplary embodiment, the multi-stage adjuster 530 may be maintained in a state in which the adjusting protrusion 532 is coupled to any one of the three spaces, that is, any one of a first state S1, a second state S2, and a third state S3.

As the state of the multi-stage adjuster 530 is changed, the position where the moving adjuster 540 is in contact with the multi-stage adjuster 530, that is, the position in the front and rear directions, may be adjusted along the extending direction of the adjusting body 520. Accordingly, the movement distance of the moving adjuster 540 may be limited, and detailed descriptions thereof will be given later.

The multi-stage adjuster 530 may be selectively exposed to the outside. Specifically, the multi-stage adjuster 530 coupled to the adjusting body 520 is covered by the first cover 511 and is not randomly exposed to the outside. When the first cover 511 is removed, the multi-stage adjuster 530 may be exposed to the outside and manipulated by the wearer or the like.

To this end, the multi-stage adjuster 530 is coupled to the adjusting body 520 in a direction that the gripping protrusion 531 to be described later is outward, that is, rightward in the exemplary embodiment.

The multi-stage adjuster 530 may be formed in a shape corresponding to the adjusting penetration 521. In the exemplary embodiment, the multi-stage adjuster 530 is configured to have a rectangular plate-shaped body, and have a polygonal cross-section in which a first adjusting end 533 protrudes from one end of the extension direction, that is, the lower end thereof.

The multi-stage adjuster 530 is located to be biased to one side of the adjusting body 520 in the extending direction. As described above, the adjusting penetration 521 to which the multi-stage adjuster 530 is coupled to be lifted is located to be biased to the rear side of the adjusting body 520. Therefore, the multi-stage adjuster 530 is also located to be biased toward the rear side of the adjusting body 520, and configured to limit the rearward movement distance of the moving adjuster 540.

In an exemplary embodiment, the multi-stage adjuster 530 includes a gripping protrusion 531, an adjusting protrusion 532, a first adjusting end 533, and a second adjusting end 534.

The gripping protrusion 531 is a portion that is gripped by the wearer or the like. The gripping protrusion 531 is configured to protrude in the direction toward the first cover 511, that is, toward the outside. The gripping protrusion 531 is located on one surface toward the outside of the surface of the multi-stage adjuster 530, that is, on the right surface in the exemplary embodiment.

The gripping protrusion 531 may be an arbitrary that protrudes from the multi-stage adjuster 530 and may be gripped by the wearer or the like. In the exemplary embodiment, the gripping protrusion 531 is configured to extend in the extension direction, that is, in the front and rear directions, of the adjusting body 520, and protrude toward the outer direction, that is, toward the right side of the thickness direction of the adjusting body 520.

The gripping protrusion 531 may be provided in plural. The plurality of gripping protrusions 531 may be disposed adjacent to each other along the extension direction of the multi-stage adjuster 530. In the exemplary embodiment, three gripping protrusions 531 are provided, and are disposed adjacent to each other along the vertical direction. It will be understood that the direction in which the plurality of gripping protrusions 531 are disposed adjacent to each other is the same as the direction in which the multi-stage adjuster 530 is moved.

The adjusting protrusion 532 is a portion where the multi-stage adjuster 530 is coupled to the adjusting body 520. The adjusting protrusion 532 is accommodated in any one of a plurality of spaces constituting the stage adjuster 522. The adjusting protrusion 532 is coupled to the stage adjuster 522 to be movable to another space located adjacent to any one of the plurality of spaces.

The adjusting protrusion 532 is configured to protrude in the direction toward the second cover 512, that is, toward the inside. Therefore, it may be said that the adjusting protrusion 532 and the gripping protrusion 531 protrude in different directions. The adjusting protrusion 532 is located on the other surface facing inward among the surfaces of the multi-stage adjuster 530, that is, on the left surface in the exemplary embodiment.

The adjusting protrusion 532 may be an arbitrary shape that protrudes from the multi-stage adjuster 530 and may be movably coupled to the stage adjuster 522. In the exemplary embodiment, the adjusting protrusion 532 has a circular cross-section and has a cylindrical shape having a height in the inward direction.

The first adjusting end 533 is in contact with the moving adjuster 540 in a state where the multi-stage adjuster 530 is located at a specific position (i.e., the second state S2), thereby limiting the movement distance of the moving adjuster 540. As described above, since the multi-stage adjuster 530 is located to be biased to the rear side of the adjusting body 520, it will be understood that the first adjusting end 533 is configured to limit the rearward movement distance of the moving adjuster 540.

The first adjusting end 533 is configured to protrude outward from one end of the extension direction of the multi-stage adjuster 530. In the exemplary embodiment, the multi-stage adjuster 530 is configured to extend in the vertical direction, and the first adjusting end 533 is configured to extend downward from the lower end of the multi-stage adjuster 530.

The first adjusting end 533 may be located to be biased to one side of the multi-stage adjuster 530 in the width direction. In this case, the one side in which the first adjusting end 533 is biased may be in the same direction as the one side in which the multi-stage adjuster 530 is biased with respect to the adjusting body 520. In the exemplary embodiment, the first adjusting end 533 is located to be biased toward the rear side of the multi-stage adjuster 530.

The second adjusting end 534 is in contact with the moving adjuster 540 in a state where the multi-stage adjuster 530 is located at another specific position (i.e., the third state S3), thereby limiting the movement distance of the moving adjuster 540. As described above, since the multi-stage adjuster 530 is located to be biased to the rear side of the adjusting body 520, the second adjusting end 534 may be configured to limit the rearward movement distance of the moving adjuster 540.

The second adjusting end 534 may be defined as one edge of the multi-stage adjuster 530. In the exemplary embodiment, the second adjusting end 534 is defined as an edge in the direction opposite to the direction in which the first adjusting end 533 is located to be biased among the edges of the multi-stage adjuster 530, that is, the front side edge.

Thus, the second adjusting end 534 is located more adjacent to the moving adjuster 540 relative to the first adjusting end 533. In other words, the second adjusting end 534 is located on the front side relatively to the first adjusting end 533.

The first adjusting end 533 may be in contact with the moving adjuster 540 in the second state S2. In addition, the second adjusting end 534 may be in contact with the moving adjuster 540 in the third state S3.

In this case, the first adjusting end 533 is located to be biased toward the rear side compared to the second adjusting end 534. Accordingly, it will be understood that the moving adjuster 540 may be further moved to the rear side as compared to the third state S3 in which the second adjusting end 534 is in contact with the moving adjuster 540.

A detailed description of the process of adjusting the state of the multi-stage adjuster 530 and restricting the movement distance of the moving adjuster 540 accordingly will be described later.

The moving adjuster 540 is coupled to the mover 400 through the wire W to substantially adjust the position of the mover 400 and the sub-visor 220 coupled thereto. The moving adjuster 540 is coupled to the adjusting body 520 to be movable in the extension direction of the adjusting body 520, that is, in the front and rear directions in the exemplary embodiment.

The moving adjuster 540 is movably coupled to the adjusting body 520. Specifically, the moving adjuster 540 may be coupled to the guide extension 523 and moved in the extension direction of the guide extension 523, that is, in the front and rear directions in the exemplary embodiment.

To this end, the moving adjuster 540 is located at a position where the guide extension unit 523 is disposed, that is, between the adjusting body 520 and the second cover 512. The moving adjuster 540 is covered by the second cover 512 and is coupled to the adjusting body 520.

In this case, the forward movement distance of the moving adjuster 540 may be limited by a protrusion formed at the front side end of the guide extension 523. In addition, the rearward movement distance of the moving adjuster 540 may be limited by the inner wall of the second cover 512 or the multi-stage adjuster 530.

Specifically, when the multi-stage adjuster 530 is located in the first state S1, the rearward movement distance of the moving adjuster 540 is limited by the inner wall of the second cover 512. When the multi-stage adjuster 530 is located in the second state S2 or the third state S3, the rearward movement distance of the moving adjuster 540 may be limited by the first adjusting end 533 or the second adjusting end 534.

In an exemplary embodiment, the moving adjuster 540 includes a gripper 541, a wire fastener 542, a guide space 543, and a contact end 544.

The gripper 541 is a portion that is gripped by a wearer or the like. The gripper 541 is disposed to be exposed to the outside of the head protection gear 10.

The gripper 541 forms one end of the moving adjuster 540 in the extension direction, that is, a lower end in the exemplary embodiment. Therefore, the gripper 541 may be exposed to the outside of the head protection gear 10 through the lower side of the cover portion 510. The wearer or the like may move the moving adjuster 540 by pressing or pulling the gripper 541.

The wire fastener 542 is a portion where the moving adjuster 540 is coupled to the wire W. The wire fastener 542 is configured to penetrate or be recessed inside the moving adjuster 540, and is coupled to the end of the wire W.

The wire fastener 542 may be located opposite to the gripper 541. That is, the wire fastener 542 may be located adjacent to the other end of the moving adjuster 540 in the extended direction, that is, the upper end in the exemplary embodiment.

The wire fastener 542 may be provided in plural. The plurality of wire fasteners 542 may be coupled to a plurality of wires W, respectively. In the exemplary embodiment, two wire fasteners 542 are provided. The number of wire fasteners 542 may be changed according to the number of wires W.

Between the gripper 541 and the wire fastener 542, the guide space 543 and the contact end 544 are formed.

The guide space 543 is a space to which the guide extension 523 is coupled. The guide space 543 may be configured to penetrate the moving adjuster 540 so that the guide extension 523 may be coupled thereto. In the exemplary embodiment, the guide space 543 is configured to penetrate in the moving direction of the moving adjuster 540, that is, in the front and rear directions.

The contact end 544 is located adjacent to the guide space 543.

The contact end 544 is in contact with one of the rear ends of the guide extension 523, that is, the first adjusting end 533, and the second adjusting end 534 according to the movement of the moving adjuster 540. By the contact, the movement distance of the moving adjuster 540 to the rear side may be limited.

The contact end 544 is formed on one surface in the direction toward the adjusting body 520, that is, on the right surface in the exemplary embodiment. The contact end 544 is configured to protrude in the direction toward the adjusting body 520, that is, toward the right side.

The contact end 544 may be located to be biased in one direction toward the multi-stage adjuster 530 among the movement directions of the moving adjuster 540, that is, the rear side in the exemplary embodiment. Therefore, as the moving adjuster 540 moves to the rear side, the contact end 544 may be in contact with one of the rear ends of the guide extension 523, that is, the first adjusting end 533, and the second adjusting end 534 first.

The head protection gear 10 according to the embodiment of the present invention described above includes a sub-visor 220 for blocking or reducing light. The sub-visor 220 may be coupled to the mover 400 that is movably coupled to the supporter 300 and move together with them. The mover 400 may be coupled to the adjuster 500 by the wire W, and the mover 400 and the sub-visor 220 may be moved by the adjustment of the adjuster 500.

At this time, the adjuster 500 is provided with the multi-stage adjuster 530 and the moving adjuster 540. The movement distance of the moving adjuster 540 is limited by the multi-stage adjuster 530. Accordingly, the wearer or the like may adjust the position of the sub-visor 220 only by simple manipulation of moving the moving adjuster 540 until it is in contact with the multi-stage adjuster 530.

Hereinafter, a process of adjusting the height of the sub-visor 220 provided in the head protection gear 10 according to the embodiment of the present invention will be described in detail with reference to FIGS. 12 to 14.

Figure 12:
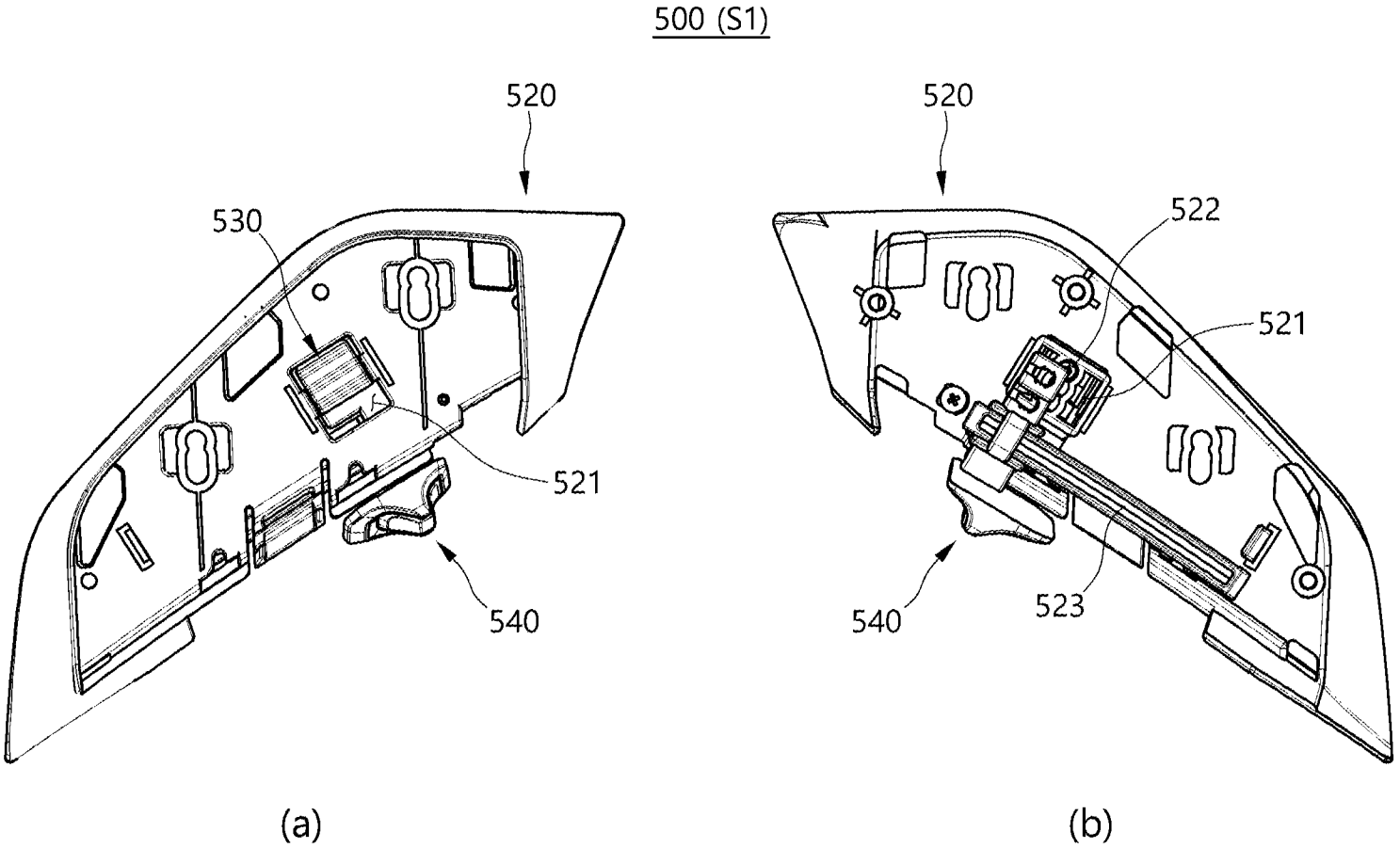
FIG. 12 is a side view showing a state in which the adjuster of FIG. 9 is adjusted to a first state S1.

Referring to FIG. 12, a state in which the multi-stage adjuster 530 is located at the uppermost side, that is, the first state S1 is shown. In the first state S1, the multi-stage adjuster is located adjacent to one end of the adjusting penetration 521 in the extension direction, that is, the upper end in the exemplary embodiment. In this case, the adjusting protrusion 532 is accommodated in a space located at the uppermost side of a plurality of spaces constituting the stage adjuster 522.

In the first state S1, the first adjusting end 533 of the multi-stage adjuster 530 is located above the guide extension 523. Accordingly, even if the moving adjuster 540 coupled to the guide extension 523 moves in the direction toward the multi-stage adjuster 530, that is, toward the rear side in the exemplary embodiment, the contact end 544 and the multi-stage adjuster 530 do not come into contact with each other.

Therefore, the moving adjuster 540 may move to the rear side until the contact end 544 is in contact with one end of the guide extension 523 in the extension direction, that is, the rear side end.

In the first state S1, when the moving adjuster 540 moves toward the multi-stage adjuster 530, that is, to the rear side in the exemplary embodiment, the mover 400 may be in contact with one end of the moving groove 320 in the extension direction, that is, the lower end in the exemplary embodiment (see (b) of FIG. 8).

In other words, as the moving adjuster 540 is maximally moved to the rear side in the first state S1, the sub-visor 220 is moved to the second position P2 at which the area covering the frame opening 120 is the largest.

Figure 13:
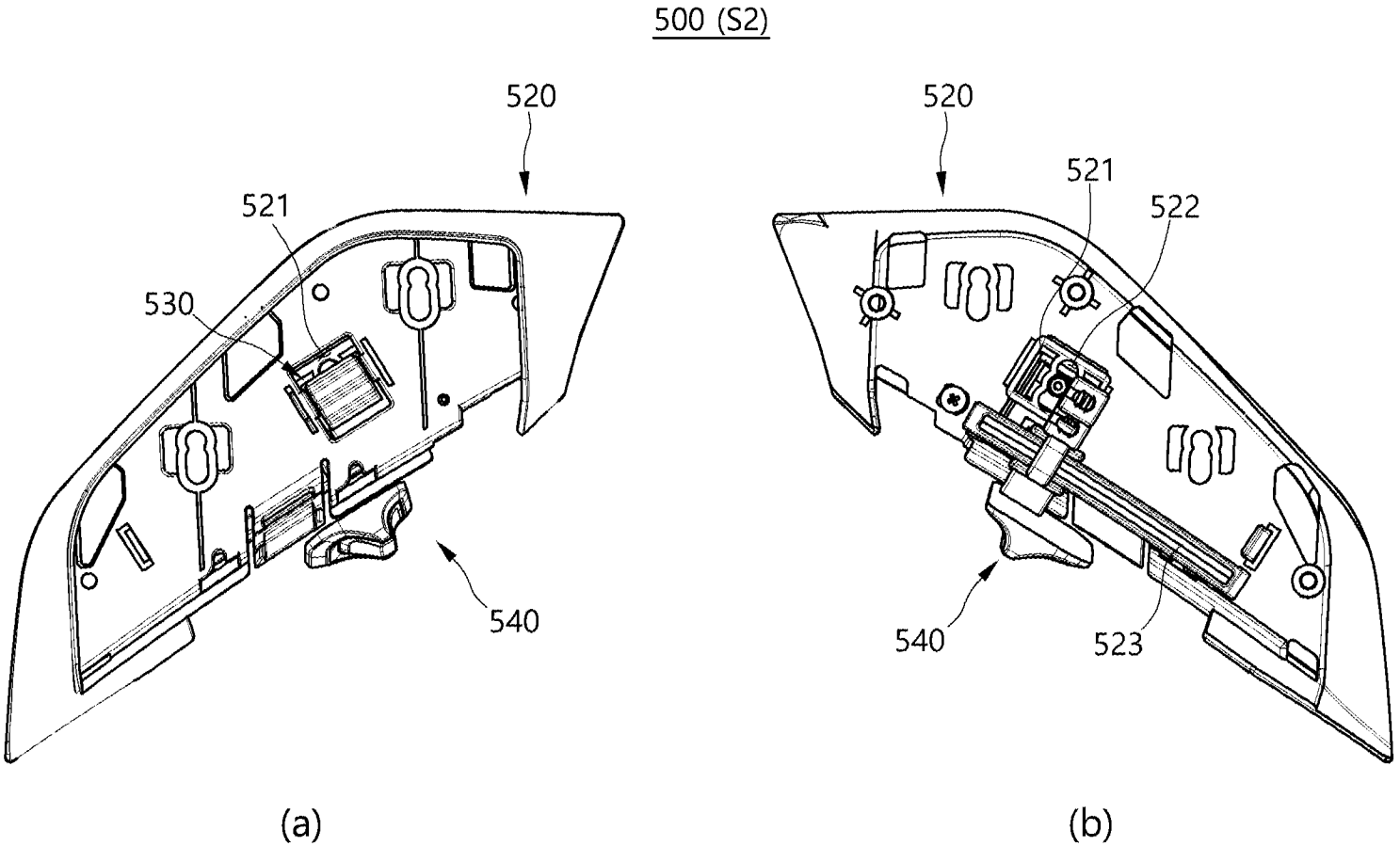
FIG. 13 is a side view showing a state in which the adjuster of FIG. 9 is adjusted to a second state S2.

Referring to FIG. 13, a state in which the multi-stage adjuster 530 is located in the middle portion, that is, the second state S2 is shown. In the second state S2, the multi-stage adjuster 530 is located between the one end and the other end of the adjusting penetration 521 in the extension direction, that is, between the upper end and the lower end in the exemplary embodiment. At this time, the adjusting protrusion 532 is accommodated in a space located in the middle of the plurality of spaces constituting the stage adjuster 522.

In the second state S2, the first adjusting end 533 of the multi-stage adjuster 530 is located adjacent to the guide extension 523, while the second adjusting end 534 is located above the guide extension 523. Accordingly, when the moving adjuster 540 coupled to the guide extension 523 moves toward the multi-stage adjuster 530, that is, toward the rear side in the exemplary embodiment, the contact end 544 comes into contact with the first adjusting end 533.

In other words, the moving adjuster 540 may be moved to the rear side until the contact end 544 is in contact with the first adjusting end 533. At this time, the first adjusting end 533 is configured to have a predetermined width. Thus, it will be understood that the position where the contact end 544 is in contact with the first adjusting end 533 is located on the front side relative to the position where the contact end 544 is in contact with the rear end of the guide extension 523.

As a result, in the second state S2, the moving adjuster 540 has a reduced movement distance toward the rear side compared to the first state S1. In other words, the moving adjuster 540 moved to the rear end in the second state S2 is located at the front side compared to the moving adjuster 540 moved to the rear end in the first state S1.

Therefore, when the moving adjuster 540 is moved toward the multi-stage adjuster 530 in the second state S2, that is, the rear end in the exemplary embodiment, the mover 400 may be located between the one end and the other end of the moving groove 320 in the extension direction, that is, the upper end and the lower end in the exemplary embodiment.

In other words, as the moving adjuster 540 is maximally moved to the rear side in the second state S2, the sub-visor 220 is located higher than the second position P2 to partially cover the frame opening 120.

Figure 14:
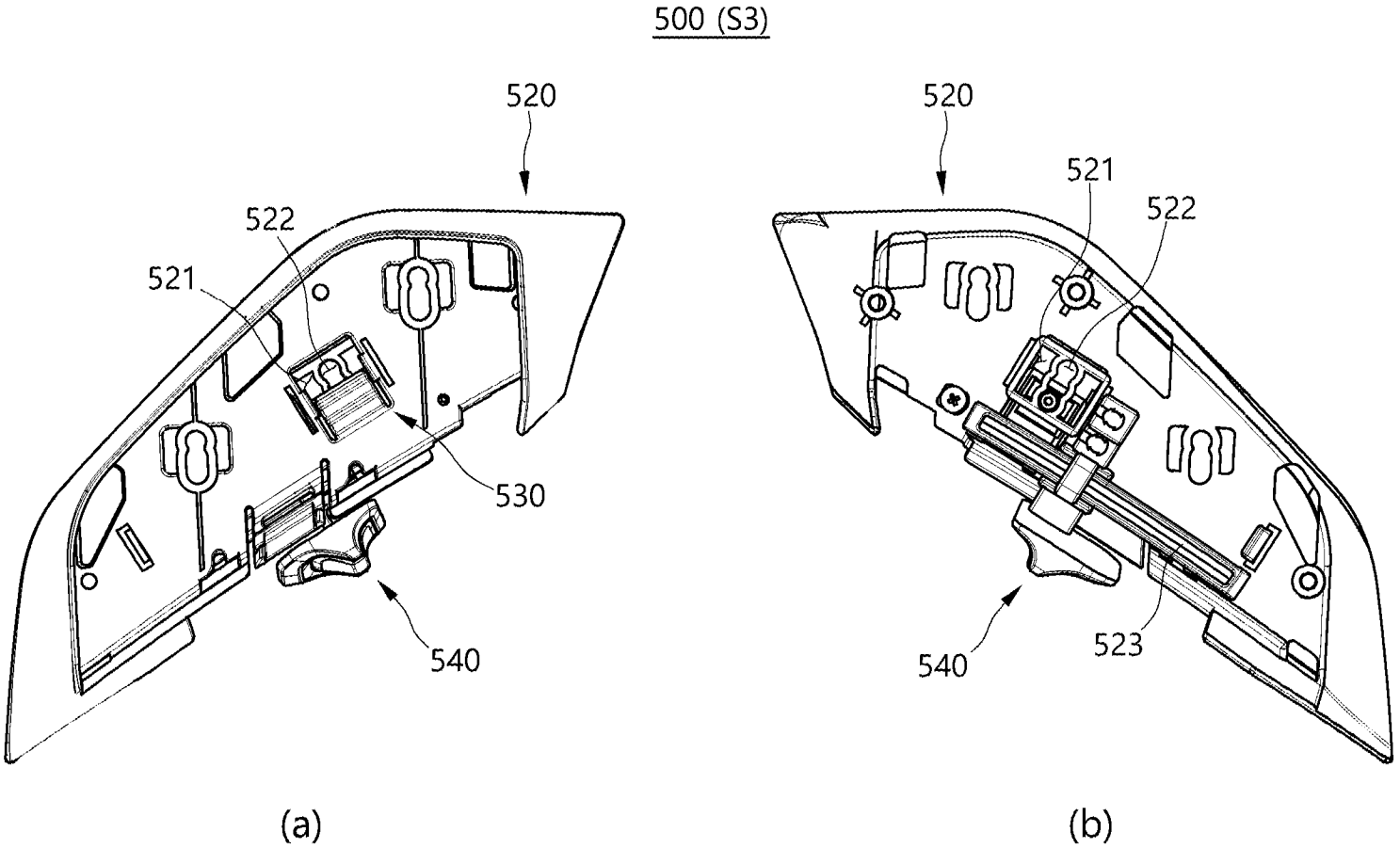
FIG. 14 is a side view showing a state in which the adjuster of FIG. 9 is adjusted to a third state S3.

Referring to FIG. 14, a state in which the multi-stage adjuster 530 is located at the lowest side, that is, the third state S3 is shown. In the third state S3, the multi-stage adjuster 530 is located adjacent to the other end of the adjusting penetration 521 in the extension direction, that is, the lower end in the exemplary embodiment. At this time, the adjusting protrusion 532 is accommodated in a space located at the lower side among the plurality of spaces constituting the stage adjuster 522.

In the third state S3, the first adjusting end 533 of the multi-stage adjuster 530 is located below the guide extension 523, while the second adjusting end 534 is located adjacent to the guide extension 523. Accordingly, when the moving adjuster 540 coupled to the guide extension 523 is moved toward the multi-stage adjuster 530, that is, toward the rear side in the exemplary embodiment, the contact end 544 comes into contact with the second adjusting end 534.

In other words, the moving adjuster 540 may be moved to the rear side until the contact end 544 is in contact with the second adjusting end 534. At this time, the second adjusting end 534 is located on front side relatively to the first adjusting end 533. Therefore, it will be understood that the position where the contact end 544 is in contact with the second adjusting end 534 is located on the front side relative to the position where the contact end 544 is in contact with the first adjusting end 533.

As a result, in the third state S3, the moving adjuster 540 has a reduced movement distance toward the rear side compared to the second state S2. In other words, the moving adjuster 540 moved to the rear end in the third state S3 is located on the front side compared to the moving adjuster 540 moved to the rear end in the second state S2.

Therefore, when the moving adjuster 540 is moved toward the multi-stage adjuster 530 in the third state S3, that is, the rear side in the exemplary embodiment, the mover 400 may be located between the one end and the other end of the moving groove 320 in the extension direction, that is, between the upper end and the lower end in the exemplary embodiment. At this time, it will be understood that the mover 400 is located relatively above compared to the second state S2.

That is, as the moving adjuster 540 is maximally moved to the rear side in the third state S3, the sub-visor 220 is located higher than the second position P2 to partially cover the frame opening 120. In this case, it will be understood that the area in which the sub-visor 220 covers the frame opening 120 is reduced compared to the second state S2.

On the other hand, when the moving adjuster 540 is moved to the direction opposite to the multi-stage adjuster 530, that is, to the front end in the exemplary embodiment, the mover 400 may be in contact with the other end of the moving groove 320 in the extension direction, that is, the upper end in the exemplary embodiment (see (a) of FIG. 8).

In other words, as the moving adjuster 540 is maximally moved to the front side, the sub-visor 220 is moved to the first position P1 at which the area covering the frame opening 120 is minimal.

Although not shown, the moving direction of the mover 400 according to the movement of the moving adjuster 540 may be configured differently.

In other words, in the exemplary embodiment, when the moving adjuster 540 is moved to the front side, the mover 400 is configured to be lifted, and when the moving adjuster 540 is moved to the rear side, the mover 400 is configured to be lowered. Alternatively, when the moving adjuster 540 is moved to the front side, the mover 400 is configured to be lowered, and when the moving adjuster 540 is moved to the rear side, the mover 400 is configured to be lifted.

Although the present invention has been described, the spirit of the present invention is not limited by the embodiments presented in this specification, and those skilled in the art who understand the spirit of the present invention may easily propose other embodiments by addition, modification, deleting, and adding components within the same spirit, but this is also within the spirit of the present invention.

| | |
|---|---|
| 10: head protection gear | 100: outer frame |
| 110: accommodation space | 120: frame opening |
| 200: visor | 210: main visor |
| 220: sub-visor | 221: sub-visor body |
| 222: sub-protrusion | 223: sub-opening |

-continued

| | |
|---|---|
| 300: supporter | 310: supporting body |
| 320: moving groove | 320a: first moving groove |
| 320b: second moving groove | 321: first extension |
| 322: second extension | 330: guider |
| 331: guide groove | 332: guide edge |
| 400: mover | 410: moving body |
| 420: moving protrusion | 421: first moving protrusion |
| 422: second moving protrusion | 430: guide protrusion |
| 440: visor coupler | 441: coupling opening |
| 442: coupling space | 443: coupling protrusion |
| 500: adjuster | 510: cover |
| 511: first cover | 512: second cover |
| 520: adjusting body | 521: adjusting penetration |
| 522: stage adjuster | 523: guide extension |
| 530: multi-stage adjuster | 531: gripping protrusion |
| 532: adjusting protrusion | 533: first adjusting end |
| 534: second adjusting end | 540: moving adjuster |
| 541: gripper | 542: wire fastener |
| 543: guide space | 544: contact end |
| P1: first position | P2: second position |
| S1: first state | S2: second state |
| S3: third state | C1: first curvature |
| C2: second curvature | Center1: first center |
| Center2: second center | W: wire |

The invention claimed is:

1. A head protection gear comprising:

an outer frame configured to open at a front side thereof via a frame opening;

a sub-visor configured to partially cover the front side of the outer frame and be movably coupled to the outer frame;

a supporter configured to be coupled to the outer frame and the sub-visor, respectively, and movably support the sub-visor; and a mover configured to be movably coupled to the supporter, and be movably together with the sub-visor while being connected to the sub-visor;

wherein the mover is configured to be moveable between a first position at which the sub-visor uncovers the frame opening; and a second position at which the sub-visor at least partially covers the frame opening, and wherein the supporter includes:

a supporting body configured to extend in one direction; and a moving groove formed inside the supporting body and extending between each end of the supporting body in the extension direction, wherein the mover is moveable coupled to the moving groove.

2. The head protection gear of claim 1, wherein the moving groove configured to penetrate the supporting body.

3. The head protection gear of claim 2, wherein the moving groove includes:

a first extension configured to have a center on one of a front side and a rear side, and extend with a predetermined first curvature; and a second extension configured to be continuous with the first extension, and have a center on the other of the front side and the rear side, and extend with a predetermined second curvature.

4. The head protection gear of claim 3, wherein the first curvature of the first extension and the second curvature of the second extension are different from each other.

5. The head protection gear of claim 3, wherein the first curvature of the first extension is configured to be greater than or equal to the second curvature of the second extension.

6. The head protection gear of claim 3, wherein one of the first curvature of the first extension and the second curvature of the second extension is zero.

7. The head protection gear of claim 2, wherein the moving groove includes:

a plurality of extension, each of which forms a part thereof and is continuous with each other, wherein a pair of the extensions formed adjacent to each other among the plurality of extensions have centers on different sides of the front side and a rear side, respectively, and extend with different curvatures.

8. The head protection gear of claim 2, wherein the supporter includes:

a guider disposed to be spaced apart from the moving groove, and configured to extend between each end of the supporting body in the extension direction of the supporting body to guide the movement of the mover coupled to the supporter.

9. The head protection gear of claim 8, wherein the guider includes:

a guide groove configured to penetrate the supporting body; and a guide edge configured to cover the guide groove from the outside, and extend along the guide groove to support the mover coupled to the supporter.

10. The head protection gear of claim 1, wherein the mover includes:

a visor coupler to which the sub-visor is coupled; and a guide protrusion configured to protrude toward the supporter and movably coupled to a guide groove of the supporter.

11. The head protection gear of claim 10, wherein the mover includes:

a moving protrusion disposed to be spaced apart from the guide protrusion, and configured to protrude toward the supporter to be movably coupled to a moving groove penetrating the supporter.

12. The head protection gear of claim 1, the head protection gear comprising:

an adjuster configured to be movably provided on the outer frame, and disposed to be spaced apart from the supporter and the mover; and a wire configured to be respectively coupled to the adjuster and the mover, and moved together with them.

13. The head protection gear of claim 12, wherein the adjuster includes:

a multi-stage adjuster configured to be movably coupled to the outer frame along a predetermined path in one direction; and a moving adjuster configured to be movably coupled to the outer frame and the wire in a direction toward the multi-stage adjuster and in a direction opposite thereto along the other direction.

14. The head protection gear of claim 13, wherein the multi-stage adjuster is maintained in one of:

a first state located adjacent to one end of the predetermined path and spaced apart from the moving adjuster;

a second state located between one end and the other end of the predetermined path and in contact with the moving adjuster; and a third state located adjacent to the other end of the predetermined path and in contact with the moving adjuster.

15. The head protection gear of claim 14, wherein the multi-stage adjuster includes:

a first adjusting end configured to protrude toward the one direction and be in contact with the moving adjuster in the second state; and a second adjusting end configured to be continuous with the first adjusting end and be in contact with the moving adjuster in the third state.

16. The head protection gear of claim 15, wherein when the moving adjuster is maximally moved in a direction opposite to the multi-stage adjuster, the mover is moved to the first position.

* * * * *